US008506204B1

(12) United States Patent
Reames et al.

(10) Patent No.: US 8,506,204 B1
(45) Date of Patent: Aug. 13, 2013

(54) STRIKE-OFF ACCESSORY DEVICE, PARTICULARLY FOR USE WITH A VEHICLE

(75) Inventors: Rex William Reames, Belle Center, OH (US); Steven Richard Cooper, Bellefontaine, OH (US); Robert Eugene Watt, Lewistown, OH (US); Charles Dallas Sullivan, Belle Center, OH (US); Tony Stephen Elliott, Bellefontaine, OH (US); Luke Cole Reames, Belle Center, OH (US)

(73) Assignee: Quality Paving LLC, Belle Center, OH (US)

( * ) Notice: Subject to any disclaimer, the term of this patent is extended or adjusted under 35 U.S.C. 154(b) by 7 days.

(21) Appl. No.: 13/253,052

(22) Filed: Oct. 4, 2011

(51) Int. Cl.
*E01C 19/00* (2006.01)
*E01C 19/26* (2006.01)

(52) U.S. Cl.
CPC ..... *E01C 19/266* (2013.01)
USPC ..... 404/86

(58) Field of Classification Search
CPC ..... E01C 19/266
USPC ..... 404/84.05–88, 90, 118; 172/437, 172/439, 449, 799.5
See application file for complete search history.

(56) References Cited

U.S. PATENT DOCUMENTS 4,073,346 A * 2/1978 Groth et al. ..... 172/439
4,395,156 A * 7/1983 Sprague, III ..... 404/110
4,871,025 A * 10/1989 Mayfield et al. ..... 172/4.5
4,878,713 A * 11/1989 Zanetis ..... 299/39.5
5,172,499 A * 12/1992 Griffin ..... 37/407
5,697,731 A * 12/1997 Bonds ..... 404/92
5,860,764 A * 1/1999 Roberts ..... 404/93
6,168,348 B1 * 1/2001 Meyer et al. ..... 404/90
6,354,383 B1 * 3/2002 Muilenburg ..... 172/817
6,481,925 B1 11/2002 Olson
7,021,398 B1 * 4/2006 Marshall ..... 172/788
7,195,423 B2 3/2007 Halonen et al.
7,311,465 B2 12/2007 Guntert, Jr. et al.
7,316,520 B2 1/2008 Grubba
8,025,458 B2 9/2011 Musil et al.
8,118,111 B2 * 2/2012 Armas ..... 172/779
8,205,359 B2 * 6/2012 Gordon ..... 37/105
8,246,271 B2 * 8/2012 Verhoff ..... 404/117

OTHER PUBLICATIONS

Printout of DR 150 Utility Trench Paver brochure from www.ditchrunner.net website, dated Oct. 21, 2008.

* cited by examiner

*Primary Examiner* — Raymond W Addie
(74) *Attorney, Agent, or Firm* — The Law Office of Patrick F. O'Reilly III, LLC

(57) ABSTRACT

A strike-off accessory device, which is configured to be mounted on a vehicle, includes a strike-off assembly for leveling the top surface of a bulk material, the strike-off assembly having a first side member, a second side member spaced apart from the first side member by a lateral distance, and at least one rear member disposed between the first side member and the second side member, the at least one rear member including a bottom edge that is configured to contact the bulk material; and a mounting assembly operatively coupled to the strike-off assembly, the mounting assembly configured to structurally support the strike-off assembly from the vehicle. In one embodiment of the invention, the lateral distance between the first member and the second member of the strike-off assembly is selectively adjustable by a user of the strike-off accessory device. In another embodiment, the vehicle is a skid-steer loader.

20 Claims, 17 Drawing Sheets

Front View

Side View

Front View

STRIKE-OFF ACCESSORY DEVICE, PARTICULARLY FOR USE WITH A VEHICLE

CROSS-REFERENCE TO RELATED APPLICATIONS

Not Applicable

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

1. Field of the Invention

The invention generally relates to an apparatus for facilitating the leveling of a bulk material. More particularly, the invention relates to a strike-off accessory device that is designed for use with an on-road vehicle or off-road vehicle, such as a skid-steer loader.

2. Background and Related Art

Unquestionably, a conventional paving process that involves the hand leveling of the paving material is quite laborious and time-consuming. It necessarily involves a great deal of manual effort on the part of the paving crew. As an exemplary project, consider the steps involved in the paving of a long, narrow space between two railroad tracks that are no longer in use. Initially, the asphalt, or other paving material, must be unloaded from the dump truck that is used to transport the asphalt to the jobsite. Typically, the asphalt is unloaded from the dump truck by employing one of three alternative methods. First, if the dump truck is equipped with a small door in its tailgate and it is capable of directly accessing the area being paved, the asphalt can be transferred directly into the space between the railroad tracks by discharging the asphalt through the small door in the tailgate of the dump truck. Secondly, if the area being paved cannot be fed directly from the dump truck, the asphalt can be unloaded on the ground in close proximity to the area being paved, and then subsequently transported to the area being paved by utilizing a suitable piece of off-road machinery, such as a skid-steer loader. As a third option, the asphalt can be unloaded from the dump truck by transferring the asphalt directly into the bucket of the skid-steer loader. The asphalt will then be unloaded from the bucket of the skid-steer loader into the space between the railroad tracks being paved.

Then, after one of the abovedescribed three methods is used to feed the area being paved with asphalt, the paving crew must manually level out the asphalt using shovels (i.e., rough grade the area being paved). After which, the paving crew must finish the leveling of the asphalt with manual hand tools, such as rakes. Finally, after the paving crew has finished grading the asphalt, the paved area must be compacted using a steam roller.

During the conventional paving process described above, the hand leveling of the asphalt material significantly increases both the time and labor cost associated with a particular paving project. While others have developed devices that are capable of leveling off paving material for projects involving large paved surfaces, such as roads and parking lots, these devices have numerous limitations and drawbacks. First, the related art devices are generally too cumbersome and large to be used for narrow width paving projects. Secondly, the devices taught by the related art typically do not offer the adjustability that is necessary to accommodate diverse types of small paving projects. Finally, these related art devices are not generally capable of being readily attached to, and detached from, a vehicle being used to facilitate the paving process.

Therefore, what is needed is a strike-off accessory device, which is particularly adapted for use with a vehicle, that can be readily used for narrow width paving projects. Moreover, a strike-off accessory device is needed that offers a significant range of adjustability for accommodating various types of small paving projects. Furthermore, a need exists for a strike-off accessory device that is capable of being easily attached to, and detached from, a vehicle that is being used to facilitate the paving of a particular area.

BRIEF SUMMARY OF THE INVENTION

Accordingly, the present invention is directed to a strike-off accessory device that substantially obviates one or more problems resulting from the limitations and deficiencies of the related art.

A first object of the present invention is to provide a strike-off accessory device that is capable of being effectively used for narrow width paving projects.

A second object of the present invention is to provide a strike-off accessory device that is readily adjustable so as to accommodate various types of paving projects.

A third object of the present invention is to provide a strike-off accessory device that is capable of being easily attached to, and detached from, a vehicle that is being used during the paving of a particular area.

The aforedescribed objects are merely illustrative in nature. Additional objects and advantages of the present invention will be apparent from the following detailed description, the accompanying drawings, and the appended claims.

To achieve one or more of these objects and advantages, in accordance with a first aspect of the present invention, there is provided a strike-off accessory device configured to be mounted on a vehicle, which includes: a strike-off assembly for leveling the top surface of a bulk material, the strike-off assembly having a first side member, a second side member spaced apart from the first side member by a lateral distance, and at least one rear member disposed between the first side member and the second side member, the at least one rear member including a bottom edge that is configured to contact the bulk material; and a mounting assembly operatively coupled to the strike-off assembly, the mounting assembly being configured to structurally support the strike-off assembly from the vehicle. In this embodiment, the lateral distance between the first member and the second member is selectively adjustable by a user of the strike-off accessory device.

In a preferred embodiment of this aspect of the present invention, the lateral position of the strike-off assembly is selectively adjustable relative to a portion of the mounting assembly by the user of the strike-off accessory device.

In another preferred embodiment, the strike-off accessory device further includes at least one actuator operatively coupled to the strike-off assembly by means of at least one intermediate component and a control lever operatively coupled to the at least one actuator. In this preferred embodiment, the at least one actuator is configured to adjust the lateral position of the strike-off assembly when the control lever is displaced by the user.

In yet another preferred embodiment, the at least one actuator is a hydraulic actuator and the control lever is pivotably mounted on a hydraulic valve body, wherein the at least one actuator is fluidly coupled to the hydraulic valve body by at least one hydraulic line.

In still another preferred embodiment, the at least one rear member comprises two overlapping rear plates, one of the two overlapping rear plates being displaceable relative to the other of the two overlapping rear plates.

In yet another preferred embodiment, the strike-off accessory device further includes at least one actuator operatively coupled to the strike-off assembly and a control lever operatively coupled to the at least one actuator. In this preferred embodiment, the at least one actuator is configured to displace the one of the two overlapping rear plates when the control lever is displaced by the user, thereby adjusting the lateral distance between the first member and the second member.

In still another preferred embodiment, the at least one actuator is a hydraulic actuator and the control lever is pivotably mounted on a hydraulic valve body, wherein the at least one actuator is fluidly coupled to the hydraulic valve body by at least one hydraulic line.

In yet another preferred embodiment, an elevation of the bottom edge of the at least one rear member of the strike-off assembly is adjustable by the user of the strike-off accessory device so as to accommodate a plurality of desired bulk material depths.

In still another preferred embodiment, the strike-off accessory device further includes at least one height adjustment screw mechanism operatively coupled to the strike-off assembly by means of at least one intermediate component and at least one height adjustment control handle operatively coupled to the at least one height adjustment screw mechanism. In this preferred embodiment, the at least one height adjustment screw mechanism is configured to adjust the elevation of the bottom edge of the at least one rear member of the strike-off assembly when the at least one height adjustment control handle is rotated by the user.

In yet another preferred embodiment, the strike-off accessory device further includes at least one first actuator operatively coupled to the strike-off assembly by means of at least one first intermediate component, a first control lever operatively coupled to the at least one first actuator, at least one second actuator operatively coupled to the strike-off assembly, a second control lever operatively coupled to the at least one second actuator, at least one height adjustment screw mechanism operatively coupled to the strike-off assembly by means of at least one second intermediate component, and at least one height adjustment control handle operatively coupled to the at least one height adjustment screw mechanism. In this preferred embodiment, the at least one first actuator is configured to adjust the lateral position of the strike-off assembly relative to a portion of the mounting assembly when the first control lever is displaced by the user, the at least one second actuator is configured to adjust the lateral distance between the first member and the second member of the strike-off assembly when the second control lever is displaced by the user, and the at least one height adjustment screw mechanism is configured to adjust the elevation of the bottom edge of the at least one rear member of the strike-off assembly when the at least one height adjustment control handle is rotated by the user.

In still another preferred embodiment, the strike-off accessory device further includes a laterally-extending beam operatively coupled to both the strike-off assembly and the mounting assembly and at least one wheel assembly removably connected to the laterally-extending beam assembly, the at least one wheel assembly including an interchangeable wheel that is configured to rotate along a surface which is located adjacent to the bulk material.

In yet another preferred embodiment, the strike-off assembly is removably coupled to the laterally-extending beam by means of a plurality of collar members and a plurality of vertically-extending plates.

In still another preferred embodiment, the first side member, the second side member, and the at least one rear member are all in the form of plates.

In yet another preferred embodiment, the bulk material comprises one of the following: (i) asphalt; (ii) concrete; or (iii) gravel.

In still another preferred embodiment, the lateral distance between the first side member and the second side member is adjustable within a range between approximately thirty-six inches and approximately fifty-seven inches.

In accordance with a second aspect of the present invention, there is provided a a strike-off accessory device configured to be mounted on an off-road vehicle, which includes: a strike-off assembly for leveling the top surface of a bulk material, the strike-off assembly having a first side member, a second side member spaced apart from the first side member by a lateral distance, and at least one rear member disposed between the first side member and the second side member, the at least one rear member including a bottom edge that is configured to contact the bulk material; and a mounting assembly operatively coupled to the strike-off assembly, the mounting assembly being configured to structurally support the strike-off assembly from the off-road vehicle, the mounting assembly further being configured to matingly engage with a universal accessory attachment means on the off-road vehicle.

In a preferred embodiment of this aspect of the present invention, the off-road vehicle is a skid-steer loader and actuation components of the strike-off accessory device are operatively coupled to the hydraulic system of the skid-steer loader.

In accordance with a third aspect of the present invention, there is provided a strike-off accessory device configured to be mounted on a skid-steer loader, which includes: a strike-off assembly for leveling the top surface of a bulk material, the strike-off assembly having a first side member, a second side member spaced apart from the first side member by a lateral distance, and at least one rear member disposed between the first side member and the second side member, the at least one rear member including a bottom edge that is configured to contact the bulk material; and a mounting assembly operatively coupled to the strike-off assembly, the mounting assembly being configured to structurally support the strike-off assembly from the skid-steer loader, the mounting assembly being further configured to matingly engage with a universal accessory attachment means on the skid-steer loader.

In a preferred embodiment of this aspect of the present invention, the universal accessory attachment means is mounted to loader lift arms of the skid-steer loader.

In another preferred embodiment, the mounting assembly of the strike-off accessory device is capable of being removably connected to the universal accessory attachment means on the skid-steer loader without the use of tools.

It is to be understood that the foregoing objects and summary, and the following detailed description of the present invention, are merely exemplary and explanatory in nature. As such, the foregoing objects and summary, and the following detailed description of the invention, should not be construed to limit the scope of the appended claims in any sense.

BRIEF DESCRIPTION OF THE SEVERAL VIEWS OF THE DRAWINGS

The invention will now be described, by way of example, with reference to the accompanying drawings, in which.

Throughout the figures, the same parts are always denoted using the same reference characters so that, as a general rule, they will only be described once.

DETAILED DESCRIPTION OF THE INVENTION

Figure 1:
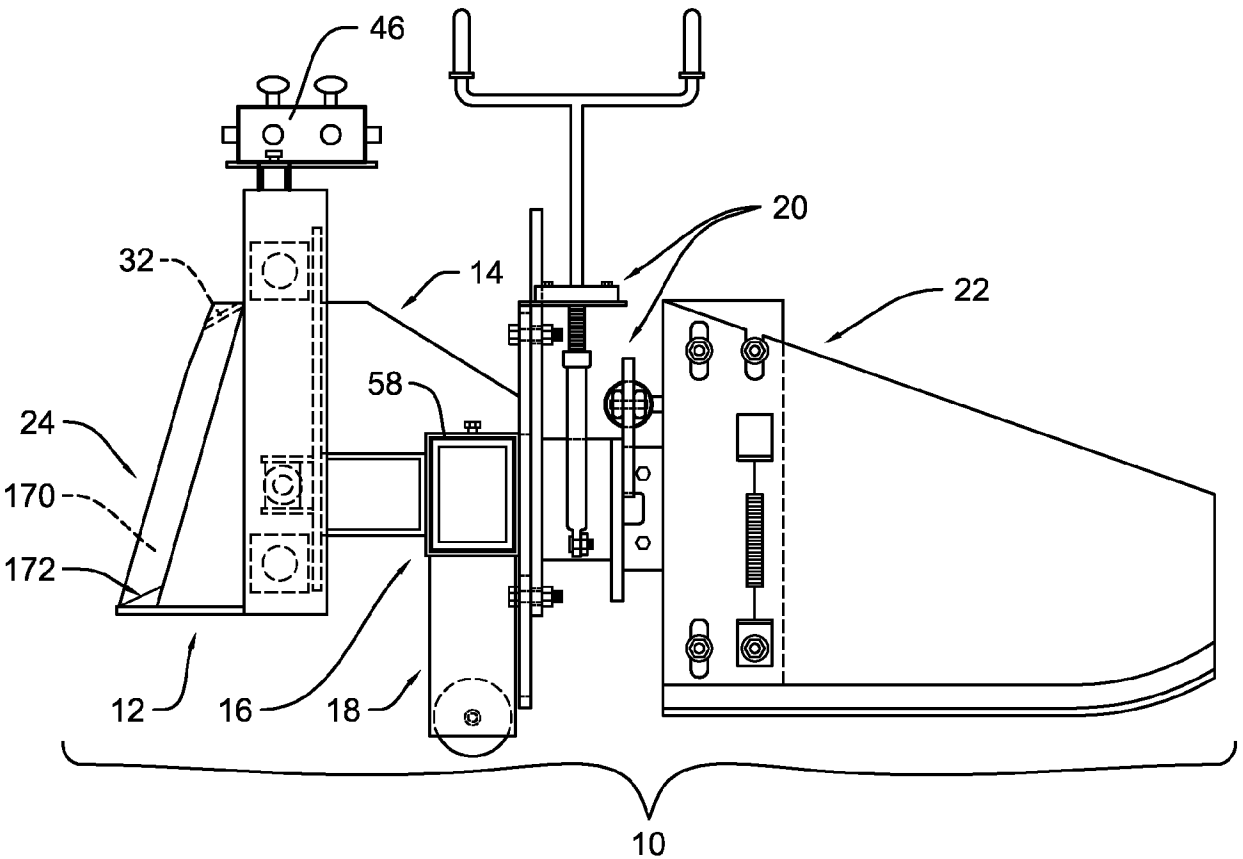
FIG. 1 is a side view of the assembled strike-off accessory device according to an embodiment of the invention.
Figure 2:
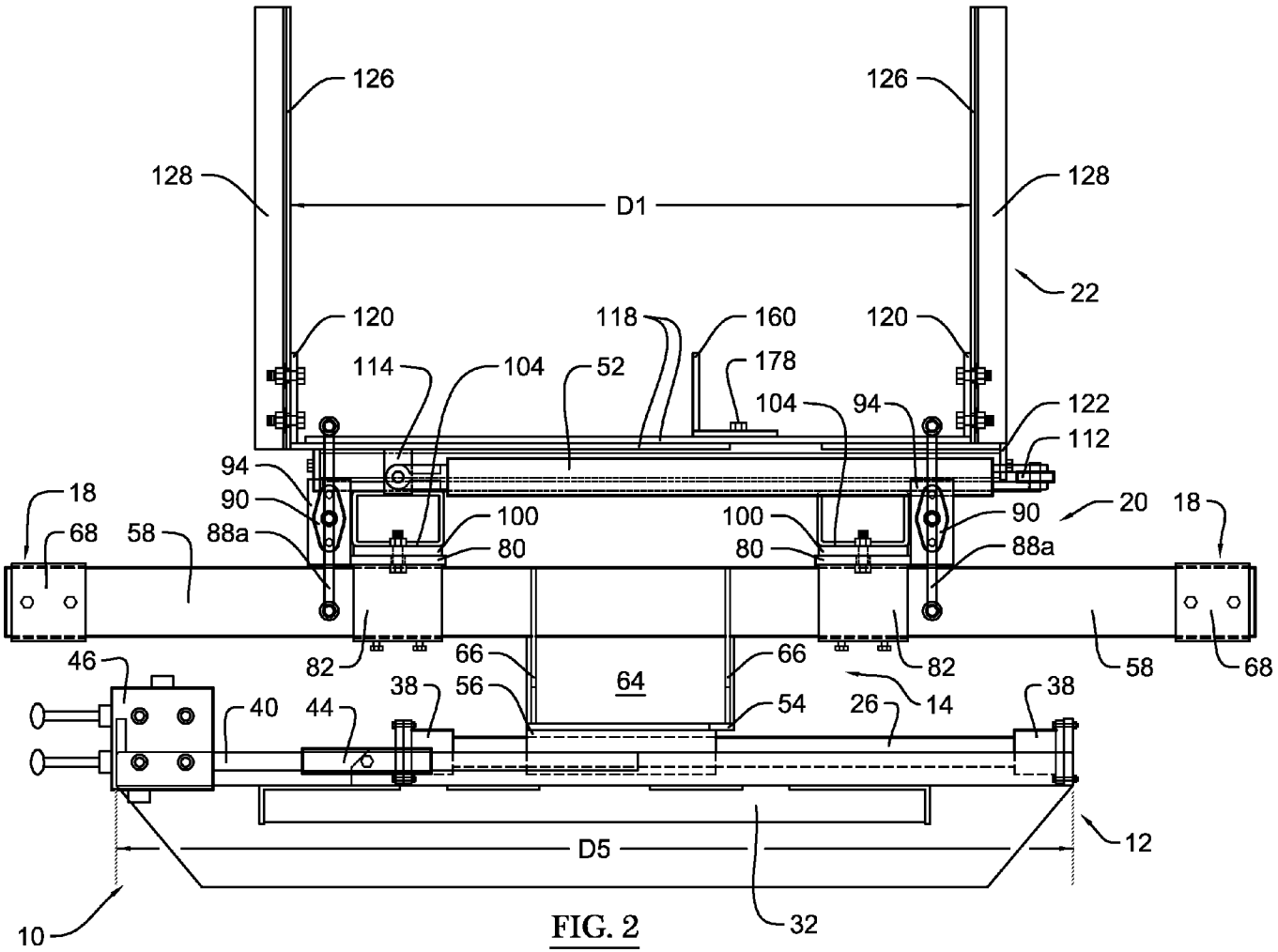
FIG. 2 is a top view of the assembled strike-off accessory device according to an embodiment of the invention.

An embodiment of the inventive strike-off accessory device (strike-off attachment) is seen generally at 10 in FIGS. 1 and 2. In this embodiment, the strike-off accessory device 10 generally comprises a universal mounting board 12, a slide plate assembly 14, a slide beam assembly 16, a plurality of sliding wheel assemblies 18, a strike-off width and height adjustment assembly 20, and a strike-off assembly 22. These components 12-22 are operatively coupled to one another such that the lateral position, width, and height of the strike-off box can be readily adjusted in order to accommodate the needs of a particular paving project. Each component of the system will be described in detail below.

Figure 3:
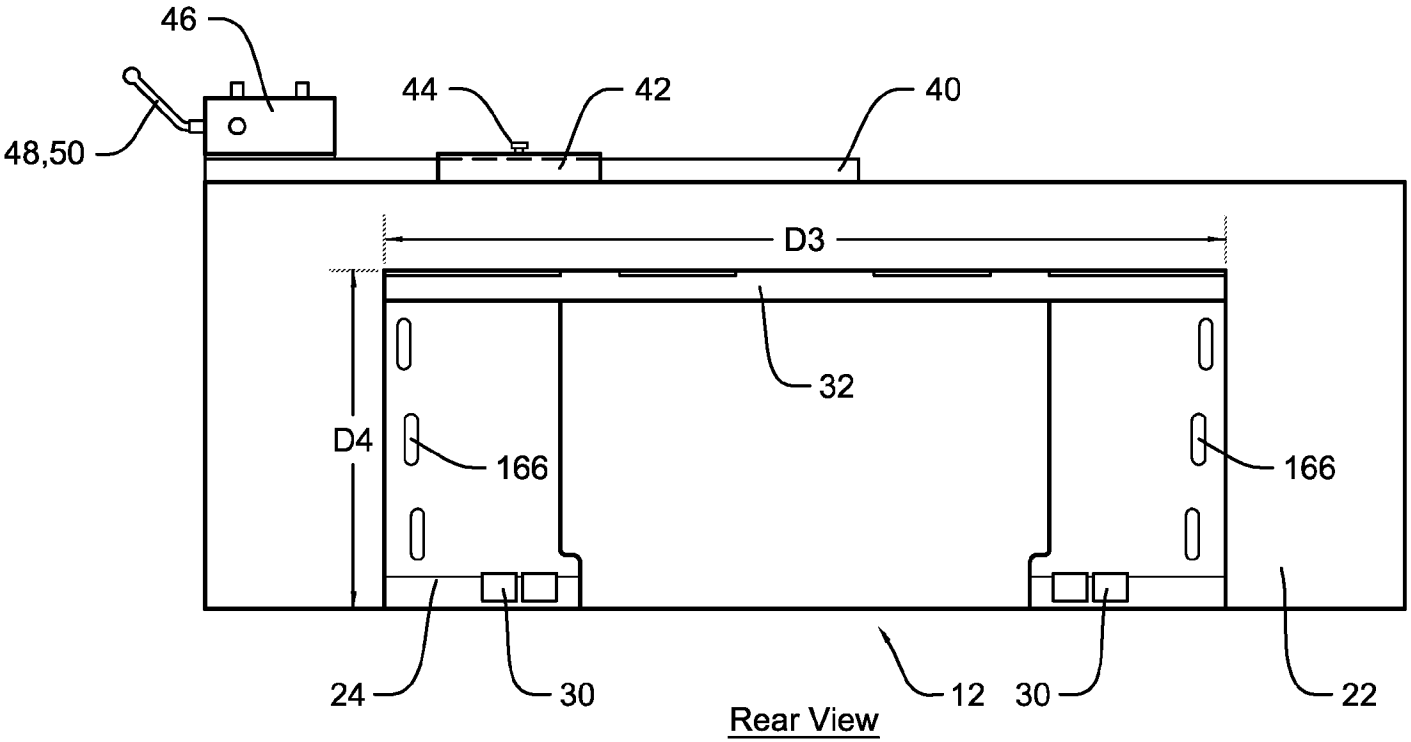
FIG. 3 is a rear view of the universal mounting board of the strike-off accessory device according to an embodiment of the invention.
Figure 4:
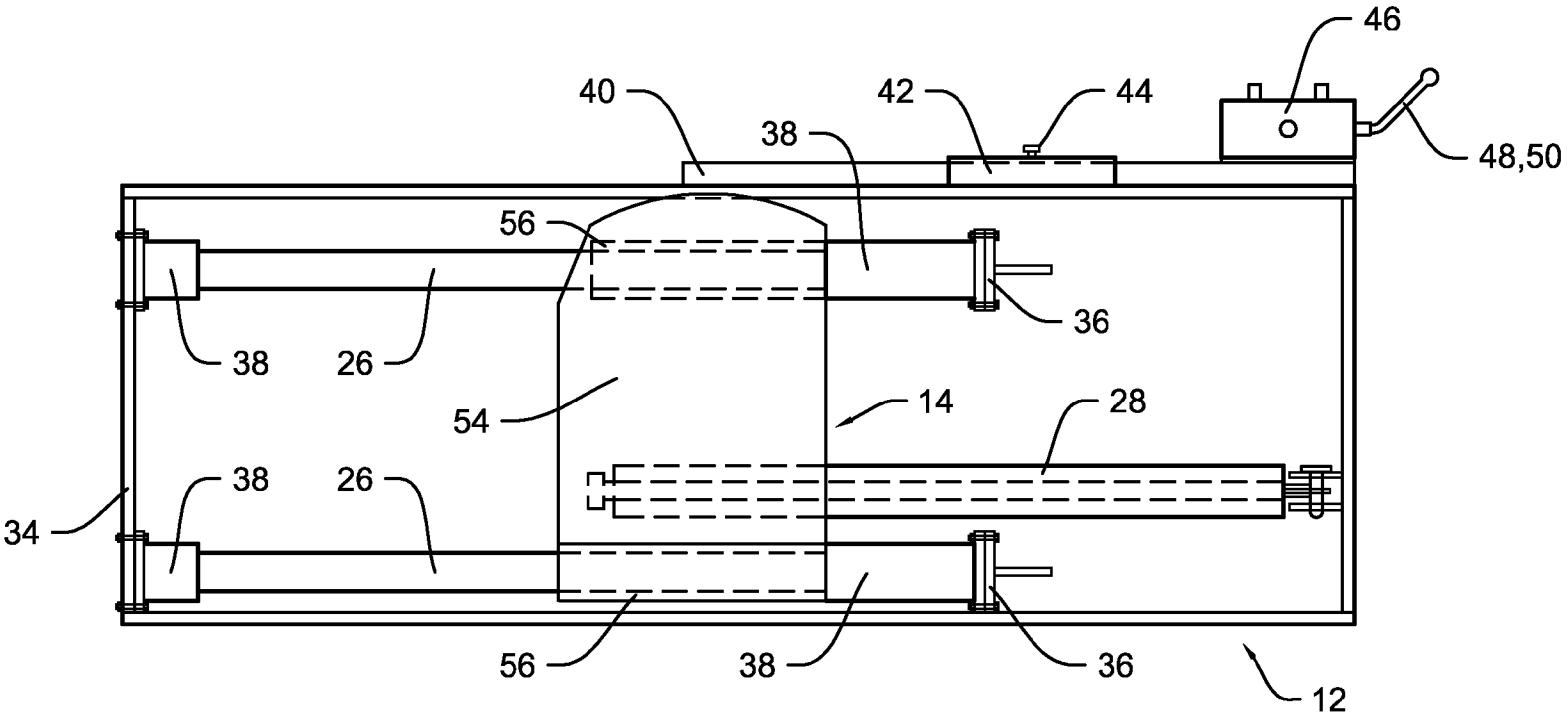
FIG. 4 is a front view of the universal mounting board of the strike-off accessory device according to an embodiment of the invention.

In the preferred embodiment of the invention, and referring to FIGS. 3 and 4, the universal mounting board 12 comprises a main frame portion 22, a latch assembly frame portion 24, a plurality of slide tubes 26, and at least one hydraulic cylinder 28. As best seen in FIG. 3, the latch assembly frame portion 24 of the universal mounting board 12 is disposed in the middle region of the main frame portion 22. The latch assembly frame portion 24 is provided with a set of three staggered apertures 166 on laterally opposing sides, as well as latch pin holes 30 at the bottom thereof. The latch assembly frame portion 24 is configured to be operatively coupled to an end of a vehicle or a mounting assembly disposed thereon by means of the latch pin holes 30 and protruding portion 32.

In a preferred embodiment, the main frame portion 22 is formed from a metal plate having a thickness of approximately three-eighths (⅜) of an inch, while the latch assembly frame portion 24 is formed from a metal plate with a thickness of approximately one-quarter (¼) of an inch. Also, in a preferred embodiment of the invention, the universal mounting board 12 has an overall length (dimension D5 in FIG. 2) of approximately sixty-five (65) inches, the protruding portion 32 has a length (dimension D3 in FIG. 3) of approximately forty-six (46) inches, and latch assembly frame portion has a height (dimension D4 in FIG. 3) of approximately eighteen (18) inches. However, it is to be understood that these thicknesses and dimensions are merely given by way of example, and in no way are intended to be limiting. Thus, it is readily appreciated that, in other embodiments, these components can be formed using other suitable dimensions, and by using plates of other thicknesses.

Now, turning to FIG. 4, it can be seen that the universal mounting board 12 includes two slide tubes 26 that are spaced apart vertically on the front face thereof. In a preferred embodiment, the slide tubes 26 are each approximately two (2) inches in diameter. However, it is to be understood that the diameter of each slide tube 26 is not so limited, and that other diameters may be used in other embodiments of the invention. An end plate 34 is disposed at the left end of each slide tube 26, while a gusset 36 is provided at the right end of each slide tube 26. Moreover, the left and right end portion of each slide tube 26 is provided with a collar portion 38 disposed therearound, inwardly from the end plate 34 and the gussets 36. As further shown in FIG. 4, a hydraulic cylinder 28 is disposed above the right end region of the lower slide tube 26. As will be described hereinafter, the hydraulic cylinder 28 enables the lateral position of the strike-off assembly 22 to be adjusted. The upper edge of the universal mounting board 12 is provided with a valve body extension tube 40 extending along a right portion thereof (see FIG. 4). A collar 42 circumscribes a portion of the valve body extension tube 40. A valve body 46 is disposed on the right end portion of the valve body extension tube 40. The lateral position of the valve body 46 can be adjusted loosening a screw 44 on the on the top of the collar 42. The valve body 46 can either be shifted inwardly towards the middle of the universal mounting board 12, or alternatively, it can moved outwardly away from the middle of the universal mounting board 12. By virtue of the extensible tube 40, the valve body 46 can be supported in a cantilevered manner over the right side of the universal mounting board 12 (see FIG. 4). When the valve body 46 has been moved to its desired position, it can be locked in place by tightening the screw 44 against the top surface of the valve body extension tube 40, thereby preventing the movement of the tube 40 and the valve body 46 fixedly attached thereto. The valve body 46 is operatively coupled to six (6) hydraulic lines that are routed to hydraulic cylinders 28, 52 used to adjust the position and the width of the strike-off assembly 22, respectively, and to the hydraulic system of the skid-steer loader. As depicted in FIG. 4, the valve body 46 is provided with two (2) control levers 48, 50 disposed on the right side thereof. The first control lever 48 is used to adjust the lateral position of the strike-off assembly 22, while the second control lever 50 is used to adjust the width of the strike-off assembly 22. The hydraulic control system of the present invention will be described in detail hereinafter.

In a preferred embodiment of the invention, the universal mounting board 12 is configured and arranged to be removably mounted to standardized accessory/attachment mounting devices utilized on skid-steer loaders by the various manufacturers thereof. In recent years, the manufacturers of skid-steer loaders have standardized the design of their accessory/attachment mounting assemblies so as to accommodate accessories/attachments made by a myriad of different manufacturers.

The sliding plate assembly 14 is slidably mounted on the universal mounting board 12. Referring to FIG. 4, it can be seen that the sliding plate assembly 14 includes a main plate portion 54, which has two cylindrical collar portions 56 fixedly attached to the rear side thereof. The two cylindrical collar portions 56 of the sliding plate assembly 14 are slidably received on the slide tubes 26. The rear face of the main plate portion 54 is also operatively connected to a left end of the hydraulic cylinder 28. In operation, when the main plate portion 54 is laterally displaced by the hydraulic cylinder 28, the lateral movement of the main plate portion 54 is restricted by the sliding engagement between the cylindrical collar portions 56 and the slide tubes 26, which only allows the main plate portion 54 to be displaced in a generally lateral direction. In addition, the weight of the assemblies 14-22 is supported by means of the engagement between the cylindrical collar portions 56 and the slide tubes 26.

Figure 6:
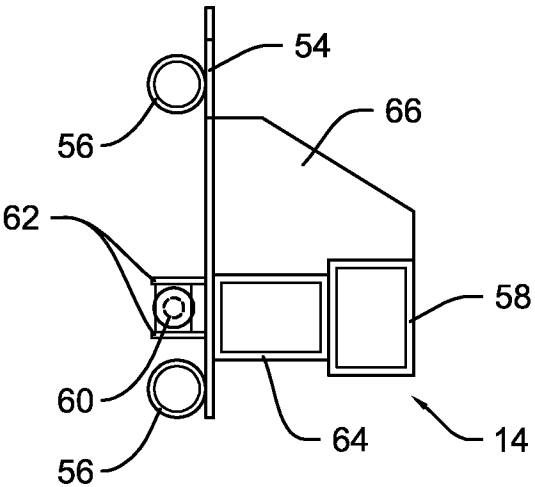
FIG. 6 is a side view of the slide plate assembly of the strike-off accessory device according to an embodiment of the invention.
Figure 5:
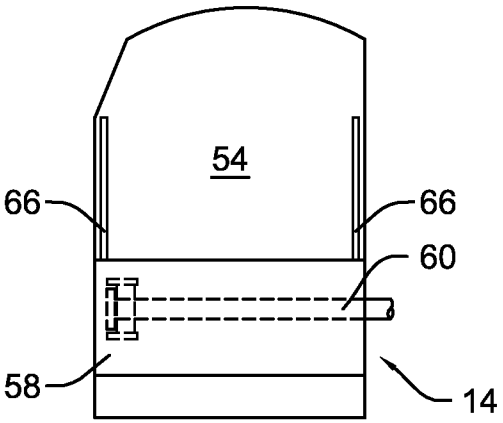
FIG. 5 is a front view of the slide plate assembly of the strike-off accessory device according to an embodiment of the invention.

In FIGS. 5 and 6, the connection between the sliding plate assembly 14 and the slide beam 58 is depicted in more detail. A movable shaft 60 of the hydraulic cylinder 28 is attached to the back of the main plate portion 54 by means of two protruding portions 62. The movable shaft 60 laterally displaces the sliding plate assembly 14 when the first control lever 48 is pressed downward by a user. As best shown in FIG. 6, a spacing beam 64 is affixed to the opposite, front side of the main plate portion 54. The purpose of the spacing beam 64 is provide a predetermined distance between the front side of the main plate portion 54 and the slide beam 58, which is attached to the front side of the spacing beam 64. In order to more securely support the slide beam 58 from the main plate portion 54, two gusset plates 66 are affixed to the main plate portion 54, the slide beam 58, and the spacing beam 64. Because the slide beam 58 supports the entire weight of the strike-off assembly 22, which is mounted in a cantilevered fashion therefrom, the connection between the slide beam 58 and the main plate portion 54 is subjected to substantial bending moment induced stresses. Thus, the gusset plates 66 are necessary to structurally support the weight of the strike-off assembly 22 from the slide plate assembly 14. While two gusset plates 66 are depicted in FIG. 5, one of ordinarily skill in the art will appreciate that a different quantity of gusset plates 66 may be used in other embodiments (e.g., more than two gusset plates 66).

In a preferred embodiment, the main plate portion 54, the slide beam 58, the spacing beam 64, and the gusset plates 66 are affixed to one another via welding. However, it is to be understood that these components could be affixed to one another using other attachment means, such as screws or other fasteners, without departing from the spirit and the scope of the claimed invention. Although, if alternative attachment means are employed, the attachment means must be sufficiently strong to the support the weight of the strike-off assembly 22.

Also, in a preferred embodiment of the invention, the slide beam 58 has a length, in the lateral direction, of approximately ninety-six (96) inches, a height of approximately six (6) inches, and width (in the left-to-right direction of FIG. 1) of approximately four (4) inches. Although, one of ordinary skill in the art will appreciate that the invention is not so limited. Rather, the slide beam 58 can be formed using other dimensions without departing from the spirit and scope of the claimed invention.

Figure 7:
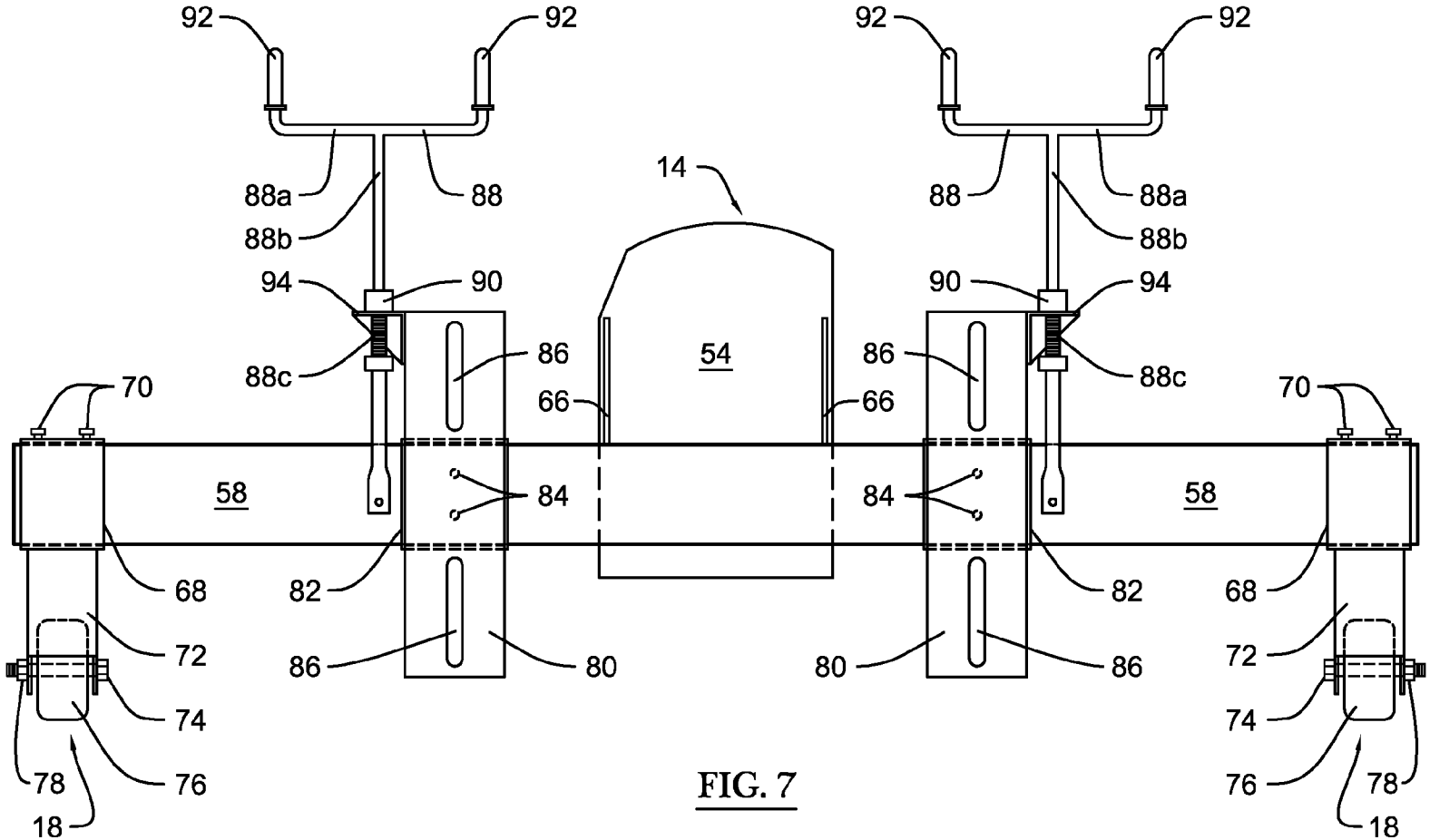
FIG. 7 is a front view of the slide plate assembly and the slide beam assembly of the strike-off accessory device according to an embodiment of the invention.

Other features of the slide plate assembly 14 and the slide beam assembly 16 are depicted in FIG. 7. As clearly illustrated by this figure, the slide beam 58 is provided with a plurality of sliding wheel assemblies 18 disposed at opposite ends thereof. Each sliding wheel assembly 18 includes a collar portion 68 that is slidably mounted on the slide beam 58. Each collar portion 68 of each sliding wheel assembly 18 is provided with two adjustable bolts 70 on the top thereof. After each collar portion 68 is moved to its desired lateral position along the slide beam 58, its adjustable bolts 70 are tighten so that their ends contact the top side of slide beam 58, thereby frictionally engaging the collar portion 68 with the slide beam 58. Thus, the sliding wheel assembly 18 is maintained in the desired stationary position. Each collar portion 68 is provided with a downwardly extending tubular portion 72 for supporting an interchangeable wheel 76 from its lower end. The interchangeable wheel 76 on each sliding wheel assembly 18 is removably attached to the two downwardly extending plates 72 by virtue of a removable bolt 74 and associated nut 78. When a user of the device needs to change the type of wheel 76 that is employed on the sliding wheel assembly 18, he or she simply unscrews the nut 78 from the bolt 74 and removes the bolt 74 from the tubular portion 72. Then, once the aperture in the new wheel 76 is aligned with the apertures in the sides of the tubular portion 72, the bolt 74 is slid through apertures in the tubular portion 72 and the wheel 76, and the nut 78 is securely screwed on the end thereof. While the wheels 76 depicted in FIG. 7 have a generally cylindrical geometry, it is to be understood that the strike-off accessory device 10 may use other types of wheels 76. For example, the inventors of the present invention have also developed wheels 76 for engaging rail members, such as those present on conventional railroad tracks. Unlike the wheels 76 depicted in FIG. 7, these wheels are provided with outwardly protruding rim portion attached to the cylindrical body of the wheel, thereby resembling the wheels typically employed railway cars. The purpose of the wheel assemblies 18 is to guide the motion of the strike-off assembly 22 as it is being movably displaced along the surface which is being paved, and to support a portion of the overall weight of the strike-off accessory device 10. More particularly, the wheel assemblies 18 facilitate the movement of the strike-off assembly 22 in a generally linear fashion along the surface undergoing paving.

Referring again to FIG. 7, it can be seen that two vertically extending plates 80 are disposed on the middle portion of the slide beam 58, on opposite sides of the main plate portion 54. Similar to the structure of the wheel assemblies 18, each of the vertically extending plates 80 is affixed on a respective collar portion 82 that is slidably mounted on the slide beam 58 by virtue of adjustable bolts 84. Like the adjustable bolts 70 on the collar portions 68 of the wheel assemblies 18, the adjustable bolts 84 of the collar portions 82 are tightened down against the slide beam 58 when the two vertically extending plates 80 have been moved to their desired lateral positions therealong. Although, unlike adjustable bolts 70 on the collar portions 68, the adjustable bolts 84 on the collar portions 82 are provided on a back side of the collar portions 82, rather than on a top side thereof. As shown in FIG. 7, each vertically extending plate 80 is provided with two elongated slots 86 disposed therethrough. The first of the two elongated slots 86 is provided beneath the slide beam 58, whereas the second of the two elongated slots 86 is provided above the slide beam 58.

Figure 18:
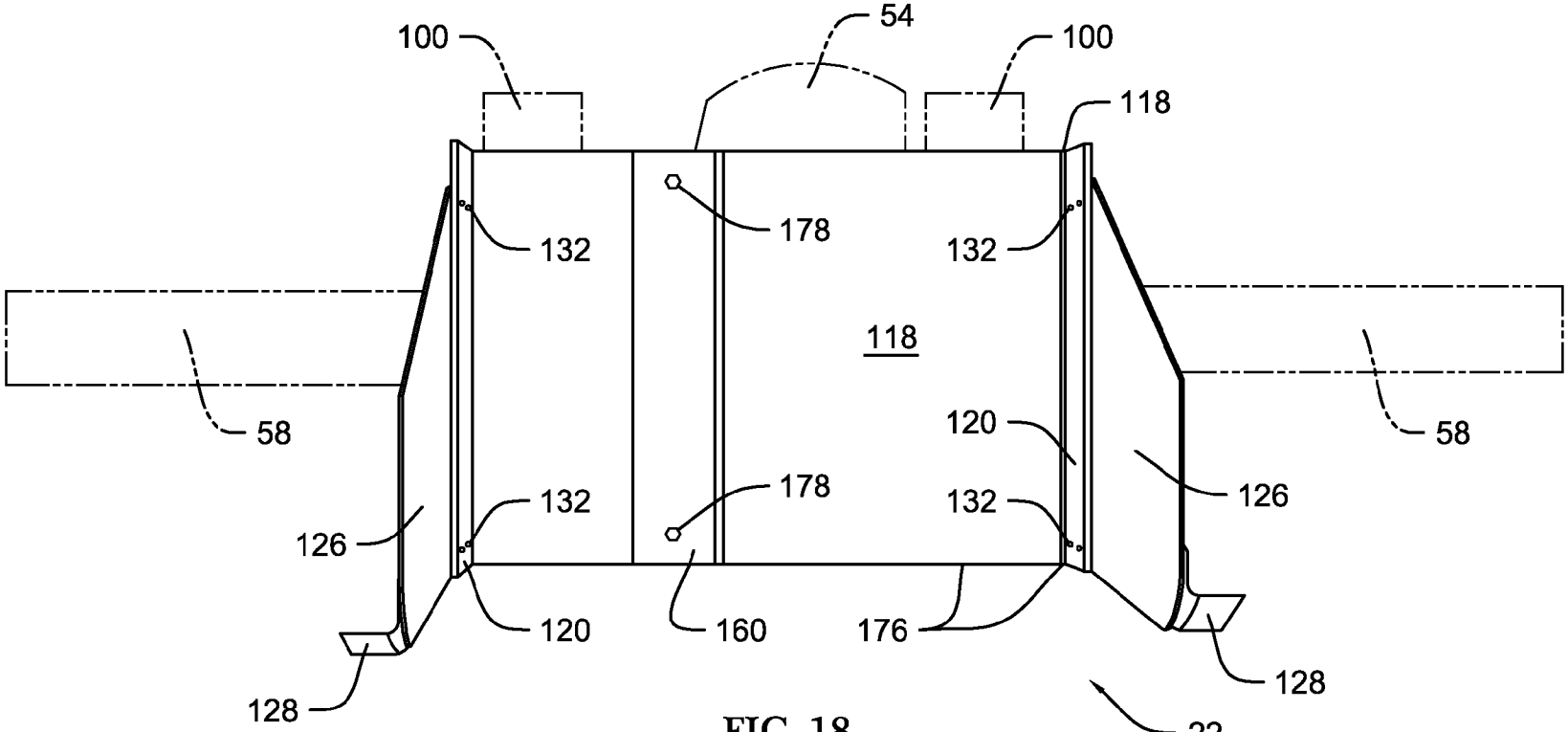
FIG. 18 is a frontal perspective view of the strike-off assembly of the strike-off accessory device according to an embodiment of the invention.

Outwardly from each vertically extending plate 80, there is provided a height adjustment control handle 88 for adjusting the vertical spacing between the bottom edge 176 of the strike-off assembly 22 (see FIG. 18) and the unpaved surface so that strike-off assembly 22 can accommodate different paving thicknesses. In particular, the height adjustment control handle 88 adjusts the height of the strike-off assembly 22 relative to the ground. Each of the two height adjustment control handles 88 includes a top U-shaped member 88*a* having two vertically disposed legs which are connected to a horizontal base leg at the lower ends thereof. In order to facilitate the grasping of the vertically disposed legs by a user, each vertically disposed leg of each U-shaped member 88*a* is provided with a handle cap 92 that substantially covers its outer surface. A downwardly extending shaft 88*b* with a threaded portion 88*c* is affixed to a center region of each horizontal leg of each U-shaped member 88*a*. The threads of each threaded portion 88*c* matingly engage with complementary internal threads provided in a respective elongated cylindrical member 88*d* that is operatively connected to a respective tubular spacing member 104. A bearing 90, which circumscribes a longitudinal portion of each downwardly extending shaft 88*b* just above the threaded portion 88*c*, is disposed on the top of a respective triangular-shaped gusset bracket 94 so as to facilitate the rotation of each height adjustment control handle 88 by reducing turning friction. When a user wishes to decrease the height of the strike-off assembly 22 relative to the ground, he or she grasps the handle caps 92 disposed on the U-shaped member 88*a* of the height adjustment control handle 88 and rotates the height adjustment control handle 88 in a clockwise direction. Conversely, when a user wants to increase the height of the strike-off assembly 22 relative to the ground, he or she rotates the height adjustment control handles 88 in an opposite counter-clockwise direction. Overall, the elevation of the bottom edge 176 of the strike-off assembly 22 (see FIG. 18) with respect to the ground is adjustable in the range from approximately four (4) inches below ground level to approximately two (2) inches above ground level. Advantageously, the approximately two (2) inches above ground level enables the strike-off assembly 22 to accommodate the installation of asphalt having a compacted thickness of approximately one and one-half (1½) inches. Although, it is to understood that the adjustability of the present invention is not limited to this specific dimensional range. Rather, other dimensional ranges could be used provided that the strike-off accessory device 10 is capable of leveling off narrow sections of pavement.

Figure 16:
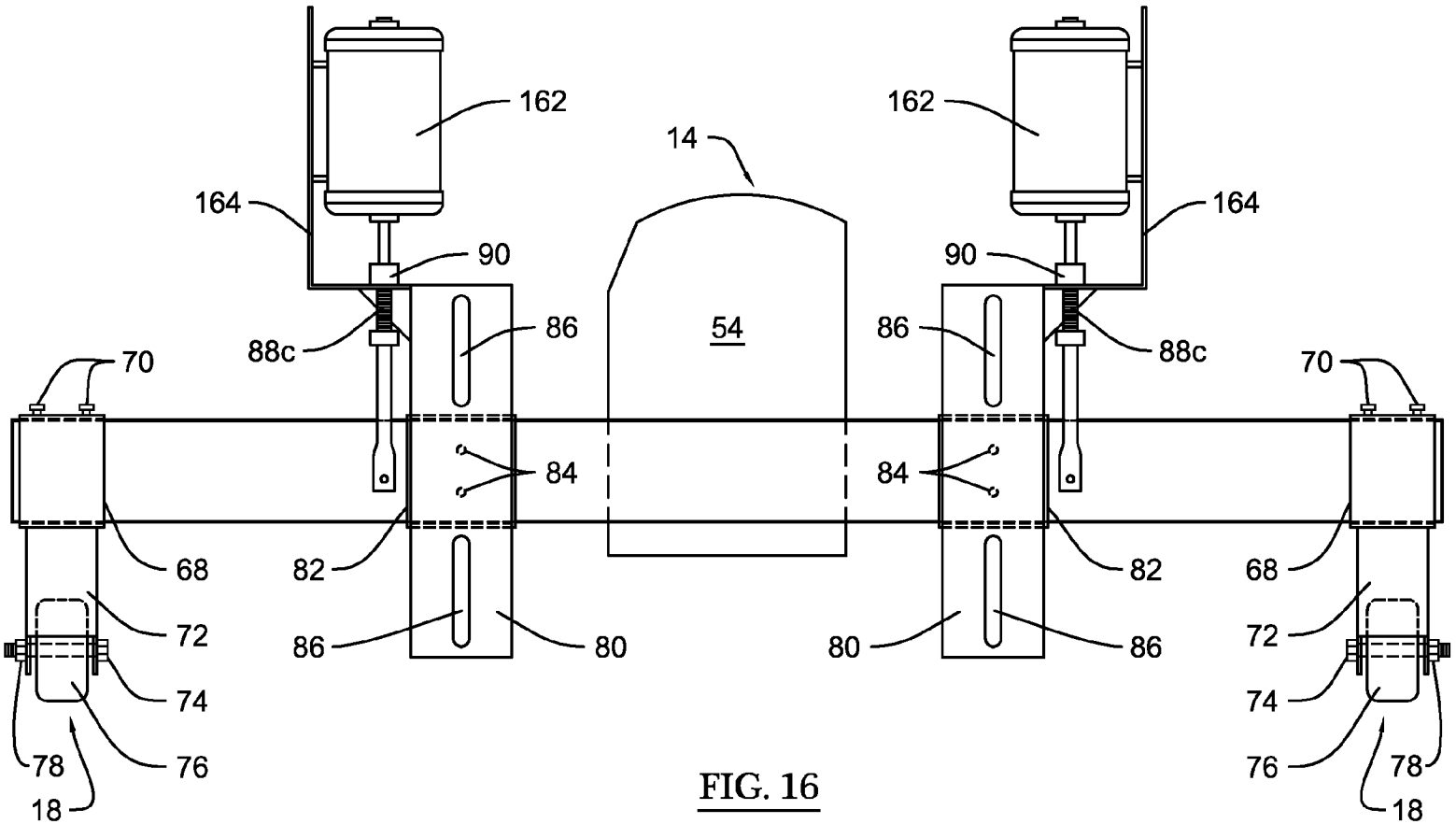
FIG. 16 is a front view of the slide plate assembly and the slide beam assembly of the strike-off accessory device according to an alternative embodiment of the invention, wherein the manual height adjustment assembly has been replaced with a powered height adjustment assembly utilizing electric motors.

While a manual height adjustment system is used to adjust the height of the strike-off assembly 22 relative to the ground in the embodiment described above, those of ordinary skill in the art will appreciate that the present invention is not so limited. Rather, a powered actuation system could be alternatively used to adjust the height of the strike-off assembly 22. For example, referring to the alternative embodiment depicted in FIG. 16, the manual height adjustment control handles 88 could be replaced with electric motors 162 that raise and lower the strike-off assembly 22. As shown in FIG. 16, the electric motors 162 are structurally supported from respective vertically extending plates 80 by means of mounting brackets 164. In such an arrangement, the electric motors 162 could be operatively connected to switches or knobs that would enable the user of the strike-off accessory device 10 to selectively adjust the height of the strike-off assembly 22 relative to the ground.

Figure 8:
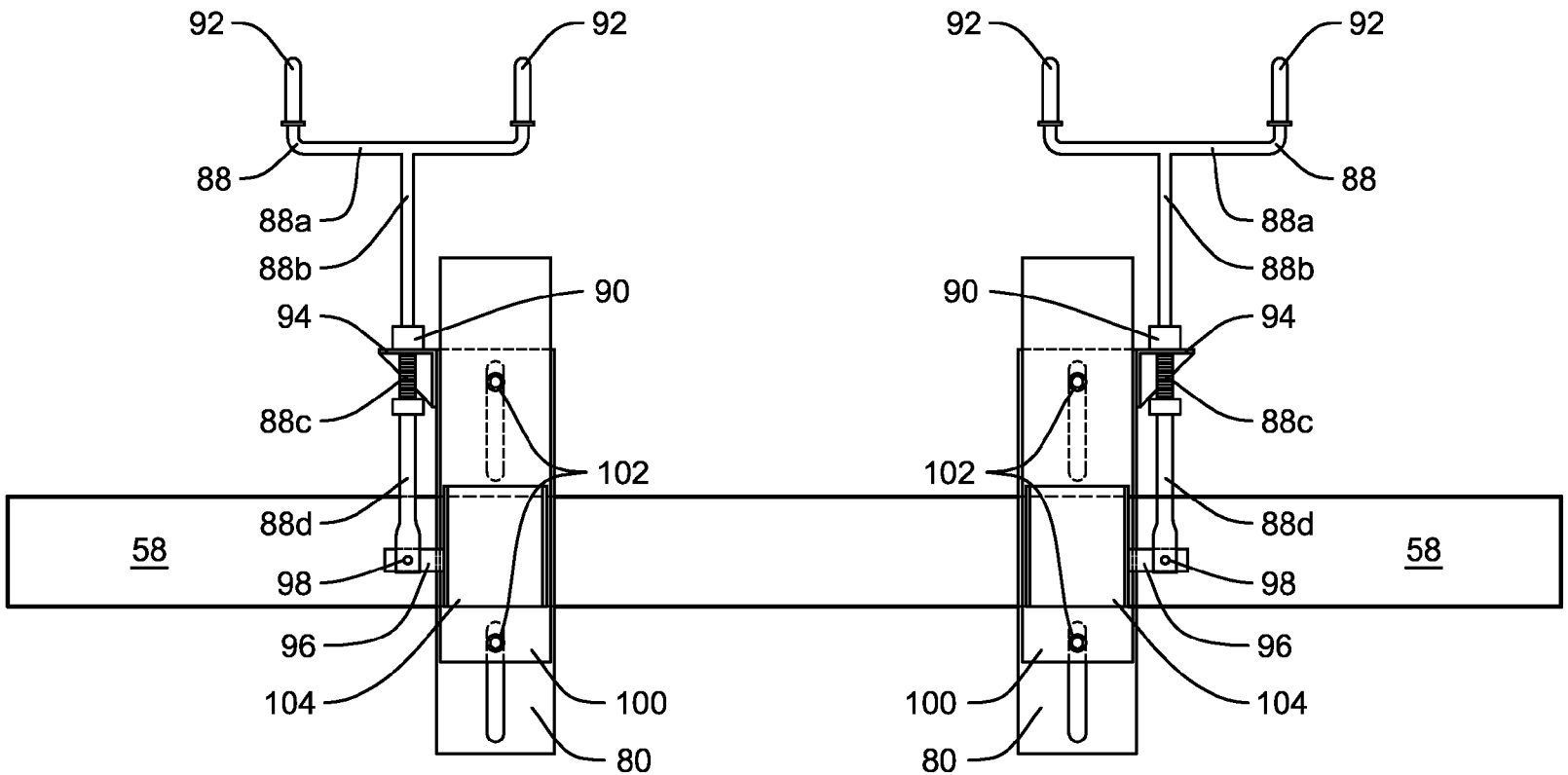
FIG. 8 is a front view of the slide beam assembly and the strike-off height adjustment sub-assembly of the strike-off accessory device according to an embodiment of the invention.
Figure 10:
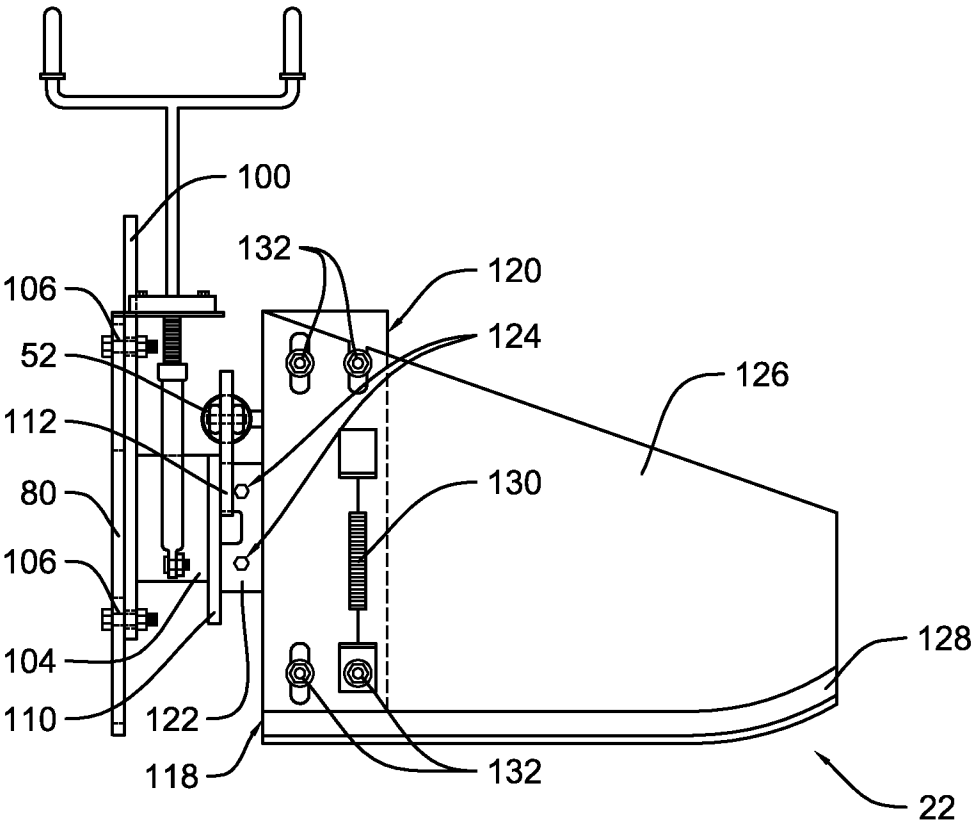
FIG. 10 is a side view of the strike-off assembly of the strike-off accessory device according to an embodiment of the invention.

In FIG. 8, several components of the strike-off attachment assembly are illustrated in conjunction with the height adjustment control handles 88 described in the preceding paragraph. As shown in this figure, two vertically extending plates 100, each of which abut one of the vertically extending plates 80, are disposed inwardly of the height adjustment control handles 88. The bottom end of each elongated cylindrical member 88*d* of each height adjustment control handle 88 is attached to a respective small, rectangular plate 96 by means of a bolt 98. Each small, rectangular plate 96 is fixedly attached (e.g., by welding) to an outer side of a respective tubular spacing member 104 (as shown in FIG. 8), which is fixedly attached to the front side of a respective vertically extending plate 100. Consequently, when each height adjustment control handle 88 is rotated in the manner described above, the vertically extending plate 100, which is operatively connected to the end of control handle 88 by means of tubular spacing member 104, is slidably displaced with respect to the adjacent vertically extending plate 80, and the height of the strike-off assembly 22 relative to the ground is modified. As shown in FIG. 2, each tubular spacing member 104 advantageously provides horizontal separation between the components of the strike-off attachment assembly. Referring to FIGS. 8 and 10, it can be seen that each of the two vertically extending plates 100 is provided with apertures 102 extending therethrough for accommodating respective adjustable bolts 106 that fasten each vertically extending plate 100 to each adjacent vertically extending plate 80.

Figure 9:
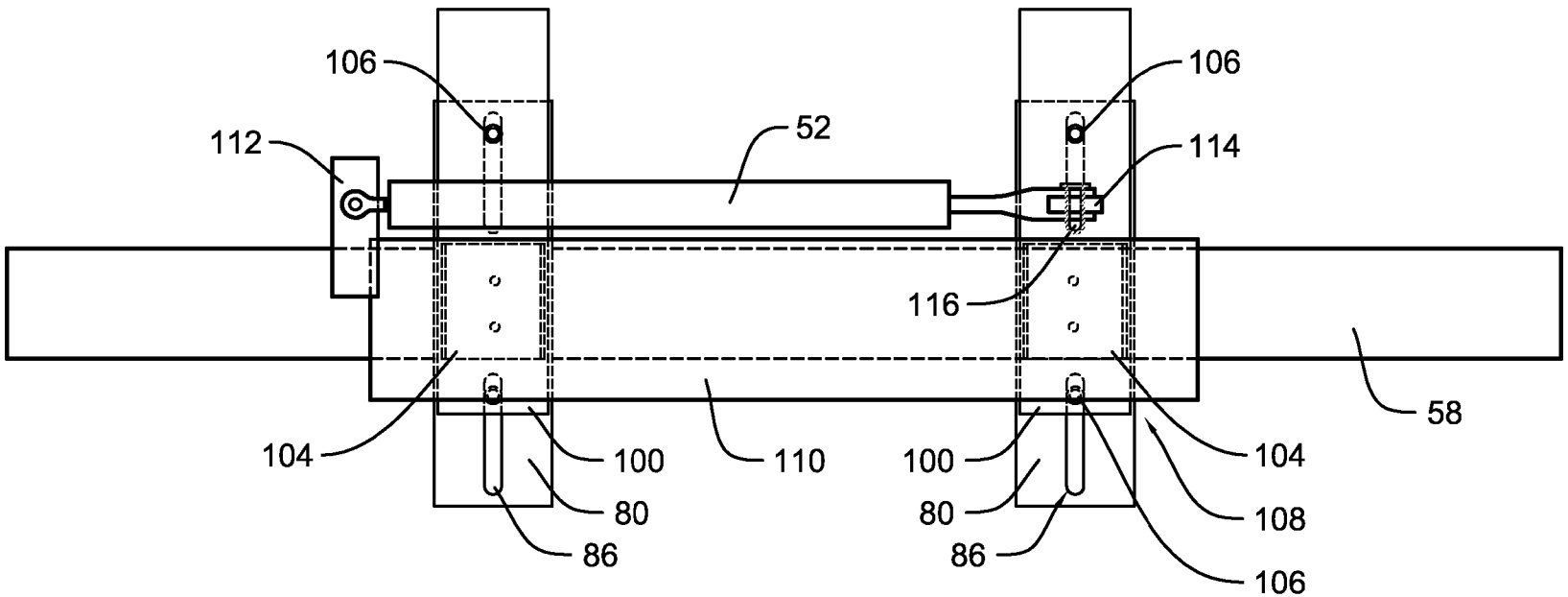
FIG. 9 is a front view of the strike-off width adjustment sub-assembly of the strike-off accessory device according to an embodiment of the invention.

The components of the strike-off width adjustment slide sub-assembly 108 are depicted in FIG. 9. As briefly mentioned above, the hydraulic cylinder 52 is used to adjust the width of the strike-off assembly 22. As shown in FIG. 9, a laterally extending support plate 110 is disposed beneath the hydraulic cylinder 52. The back of the support plate 110 is fixedly attached to each of the tubular spacing members 104 by welding or other suitable attachment means. The left end of the hydraulic cylinder 52 is attached to the top, left end of the support plate 110 by virtue of hydraulic cylinder anchor plate 112, while the right end of the hydraulic cylinder 52 is attached to an overlapping rear plate 118 of the strike-off assembly 22 via attachment plate 114 and bolt 116. As best shown in FIG. 10, the hydraulic cylinder anchor plate 112 is attached to the front face of the laterally extending support plate 110 by welding or other suitable means of attachment.

In FIG. 10, the constituent components of the strike-off assembly 22 are illustrated in conjunction with some components of the strike-off width and height adjustment assembly 20. The main frame portion of the strike-off assembly 22 comprises overlapping rear plates 118 and two side frame plates 120 that are attached to an outer edge portion of a respective overlapping rear plate 118. The two side frame plates 120 are attached generally perpendicular to each of the rear plates 118 by welding or other suitable attachment means. The rear surface of the left rear plate 118 is attached to the support plate 110 by virtue of a bracket 122. The strike-off assembly 22 additionally comprises two main side plates 126 that attached to a respective one of the two side frame plates 120 by virtue of four bolts 132. As depicted in FIG. 10, one set of bolts 132 is provided near the bottom of side frame plate 120, while the other set of bolts 132 is provided near the top of the side frame plate 120. While bolts 132 are used to attach the two main side plates 126 to the two side frame plates 120 in a preferred embodiment of the invention, it is to be understood that other suitable attachment means may also be used, such as but no limited to, welding. However, bolts 132 are the preferred means of attachment because they permit the two main side plates 126 to be disassembled from the two side frame plates 120.

As additionally shown in FIG. 10, the two main side plates 126 are provided with a tension spring 130 disposed thereon. The purpose of the tension springs 130 is to enable the two main side plates 126 to flexibly glide over uneven ground surfaces without resulting in the catching of the bottom edges of the side plates 126 on such surfaces. In other words, the tension springs 130 advantageously introduce a certain degree of "play" in the attachment means between the two main side plates 126 and the two side frame plates 120. The two main side plates 126 also are each provided with an angle bracket 128 welded to the outer bottom edge portion thereof. The angle brackets 128 improve the structural rigidity of the cantilevered main side plates 126. When the width of the strike-off assembly 22 is adjusted by the hydraulic cylinder 52, the left main side plate 126 remains stationary (when viewing the assembly 22 from the front), while the right main side plate 126 is displaced in a lateral direction. In particular, when the width of the strike-off assembly 22 is being increased, the right main side plate 126 is displaced laterally outward. Conversely, when the width of the strike-off assembly 22 is being decreased, the right main side plate 126 is displaced laterally inward towards the left main side 126. Two slide rods 124 are provided within bracket 122 for guiding the lateral displacement of the right main side plate 126 in order to ensure that it moves in a substantially linear manner. In a preferred embodiment of the invention, an angle bracket 160 (see FIG. 2) is secured by bolts 178 to one of the overlapping rear plates 118 in order to enable the strike-off accessory device 10 to be used for leveling off a portion of bulk material having a width (e.g., sixteen (16) inches) that is less than the width between the two main side plate 126 when the strike-off assembly 22 is fully contracted.

In a preferred embodiment of the invention, the strike-off assembly 22 has an unextended width (i.e., lateral distance D1 in FIG. 2) of approximately thirty-six (36) inches (i.e., when the hydraulic cylinder 52 is not extended at all) and an extended width of approximately fifty-seven (57) inches (i.e., when the hydraulic cylinder 52 is in its fully extended position). Thus, the width of the strike-off assembly is adjustable within the range of zero to approximately twenty-one (21) inches so as to accommodate different paving widths. However, it is to be understood that the present invention is not limited to these specific dimensions. Rather, other dimensions could be used to practice the invention so long as the paving accessory 10 is still suitable for leveling off narrow sections of pavement.

The strike-off accessory device 10 has an extremely versatile design that facilitates the leveling of bulk material located off-center with respect to the vehicle to which it is attached. In its standard mounting configuration, the strike-off assembly 22 is generally centered on the slide beam 58 (see FIG. 2). As depicted in FIG. 2, the collar portions 82, which operatively connect to the strike-off adjustment apparatus 20 and the strike-off assembly 22 to the slide beam 58, are disposed on opposite sides of the slide plate assembly 14. More particularly, in the illustrated embodiment, each of the collar portions 82 is substantially equally spaced from a respective gusset plate 66 on opposed lateral sides of the slide plate assembly 14. However, if it is desired, for example, to use the strike-off accessory device 10 to strike off a bulk material located in the berm of a road or pathway, or along the longitudinal boundaries of a paved trench, the strike-off assembly 22 can be repositioned in an off-centered arrangement, such as that depicted in FIG. 15.

In a preferred embodiment of the invention, the strike-off assembly 22 can be repositioned in such manner that the lateral dimension D2 in FIG. 2 between the centerline of the strike-off accessory device 10 and the inner side of the right main side plate 118 is approximately equal to seventy-two (72) inches. However, it is to be understood that this specific dimension is merely exemplary, and that other suitable dimensions can be used without departing from the spirit and scope of the invention.

Figure 15:
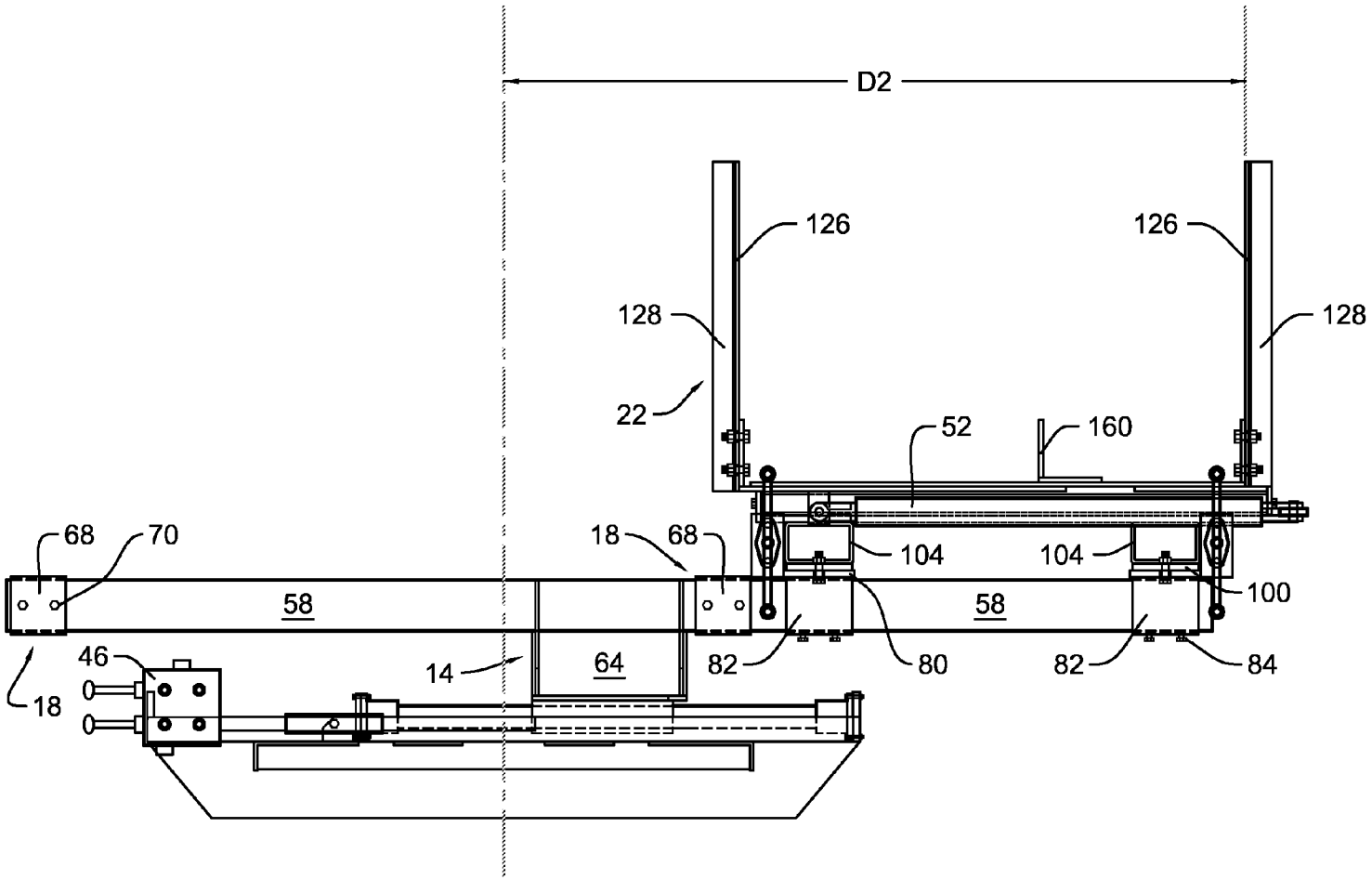
FIG. 15 is a top view of the assembled strike-off accessory device according to an embodiment of the invention, wherein the strike-off assembly has been relocated to a position outwardly from the slide plate assembly and the sliding wheel assembly.
Figure 17:
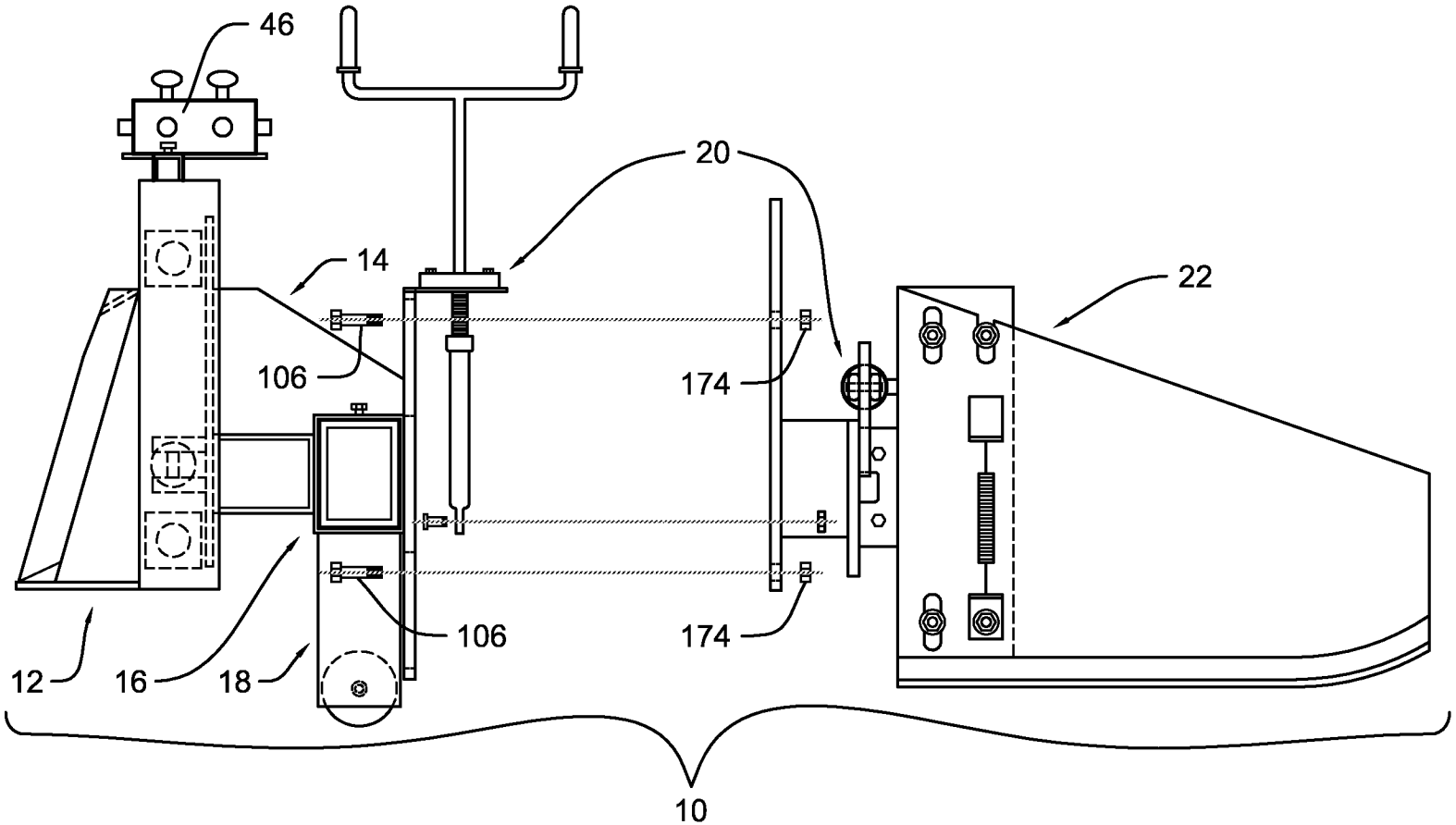
FIG. 17 is a partially exploded side view of the strike-off accessory device according to an embodiment of the invention.

The requisite steps, which are required to shift the position of the strike-off assembly 22 from that which is depicted in FIG. 2 to that which is shown in FIG. 15, will now be explained. First, a user must remove the bolts 106, which secure each of the two vertically extending plates 80 to respective vertically extending plates 100, by first removing an associated nut 174 from the end of each of the bolts 106 (refer to the exploded view depicted in FIG. 17). Then, after the strike-off assembly 22 is detached from the rest of the strike-off accessory device 10, a user loosens the bolts 70 on each of the two collar portions 68 of the sliding wheel assemblies 18. Once the bolts 70 are sufficiently loose, the sliding wheel assemblies 18 are slid outwardly along the length of the slide beam 58 towards the opposed longitudinal ends thereof, and then subsequently removed therefrom. In a similar fashion, the bolts 84 on each of the two collar portions 82 are loosened so that the collar portions 82 and the vertically extending plates 80, which are fixedly attached to respective collar portions 82, can also be removed from the slide beam 58. Like the collar portions 68 of the sliding wheel assemblies 18, the collar portions 82 are slid outwardly along the length of the slide beam 58 towards the opposed longitudinal ends thereof until they become detached therefrom. Then, the sliding wheel assemblies 18 will typically be reattached to the slide beam 58 prior to the reattachment of the strike-off assembly 22. As shown in FIG. 15, the sliding wheel assemblies 18 are preferably positioned on opposed sides of the slide plate assembly 14. After which, the collar portions 82 are repositioned on the slide beam 58 and held in place by the tightening of the bolts 84 against the rear surface of the slide beam 58. Finally, the strike-off assembly 22 is reattached to the rest of the strike-off accessory device 10 by aligning the apertures 86, 102 of abutting plates 80, 100 and removably affixing the bolts 106 therethrough using nuts 174.

Figure 11:
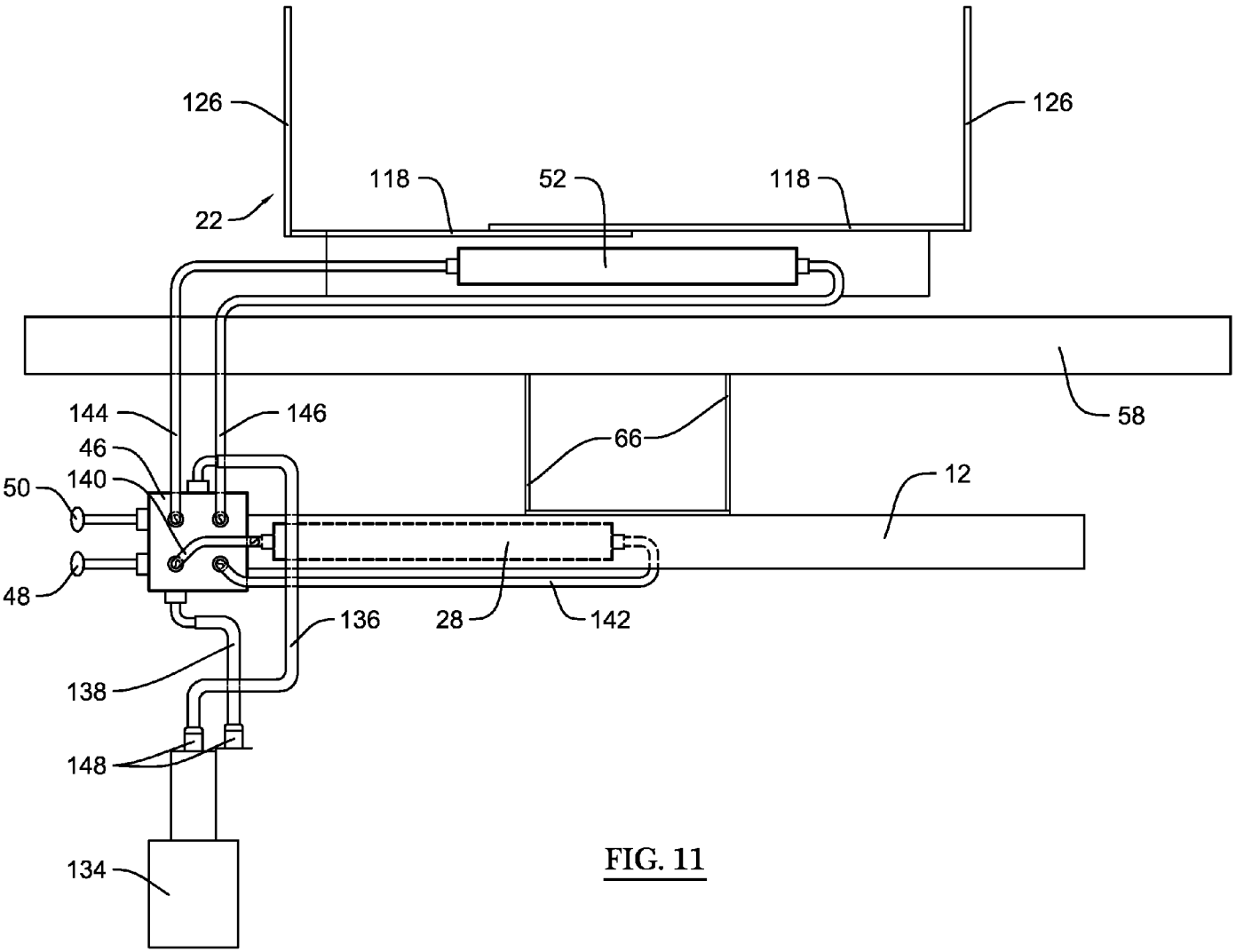
FIG. 11 is a schematic diagram of the hydraulic control system of the strike-off accessory device according to an embodiment of the invention.

In FIG. 11, the hydraulic control system of the strike-off accessory device 10 is depicted in a schematic nature. In a preferred embodiment of the invention, the valve body 46 of the hydraulic control system is operatively connected to the hydraulic line connectors 148 on the frame 134 of a skid-steer loader via a hydraulic supply line 136 and a hydraulic return line 138. Thus, the hydraulic system of the skid-steer loader is used as the supply source for the hydraulic fluid of the strike-off accessory device 10. The use of the vehicle hydraulic system advantageously minimizes the number of components required in the hydraulic control system of the present invention, as well as its overall complexity and cost. The hydraulic fluid, which is typically some form of incompressible oil, is pumped to the hydraulic control system of the present invention. Because the hydraulic system of a typical skid-steer loader is well known in the mechanical arts, a detailed discussion of skid-steer loader hydraulic system is not necessary in the disclosure at hand. As shown in FIG. 11, the valve body 46 is fluidly coupled to the first hydraulic cylinder 28 by virtue of hydraulic supply/return lines 140, 142. As described above, the first control lever 48 controls the actuation of first hydraulic cylinder 28, and hence, the adjustment of the lateral position of the strike-off assembly 22. Similarly, the valve body 46 is fluidly coupled to the second hydraulic cylinder 52 by virtue of hydraulic supply/return lines 144, 146. Also, as explained above, the second control lever 50 controls the actuation of second hydraulic cylinder 52, and hence, the adjustment of the width of the strike-off assembly 22.

While it is preferred that the hydraulic control system of the strike-off accessory device 10 be operatively coupled to the hydraulic system of a vehicle, such as a skid-steer loader, it is to be understood that the invention is not so limited. For example, in other embodiments of the invention, the hydraulic control system of the strike-off accessory device 10 could be in the form of a self-contained system, which includes a pump for distributing the hydraulic fluid throughout the system.

Also, while the actuation system of the strike-off accessory device 10 is depicted as a hydraulic-type system in the preferred embodiment of FIGS. 1-11, those of ordinary skill in the art will appreciate that other types of actuation systems may be used without departing from the spirit and scope of the invention. For example, an electric actuation system that employs electric motors, rather than hydraulic cylinders, for adjusting the lateral position and the width of the strike-off assembly could be utilized when practicing the present invention.

Now, the operation of the strike-off accessory device 10 will be explained. Initially, the universal mounting board 12 of the strike-off accessory device 10 is attached to the front structure of a vehicle, such as an off-road vehicle in the form of a skid-steer loader. Once the paving accessory 10 has been attached to the vehicle and any necessary hydraulic lines have been connected (e.g., hydraulic lines 136, 138), the paving accessory 10 is ready for use. While a surface is being paved, the front bottom edges 176 of the overlapping rear plates 118 of the strike-off assembly 22 are used to level off the top surface of the paving material when the strike-off assembly 22 is propelled in a longitudinal direction of the pavement by the skid-steer loader. If a user wishes to adjust the lateral position of the strike-off assembly 22 in order to align the strike-off assembly 22 with the surface being paved, he or she presses up or down on the first control lever 48. Similarly, if a user wants adjust the width of the strike-off assembly 22 so as to accommodate a particular installed paving width, he or she presses up or down on the second control lever 50. Lastly, if a user wants to adjust the height of the strike-off assembly 22 above the ground in order to accommodate a desired paving depth, he or she rotates the height adjustment control handles 88 in either a clockwise or counterclockwise direction depending on whether the user wants to lower or raise the strike-off assembly 22.

Advantageously, using the strike-off accessory device 10 while paving an area eliminates nearly all hand leveling of the bulk material (e.g., asphalt) that would otherwise be required during the conventional paving process. If, for example, the asphalt is unloaded from dump truck by transferring it directly into the bucket of a skid-steer loader, the skid-steer loader can feed the strike-off accessory device 10 by dumping the asphalt in the space between the two main slide plates 126 (i.e., the asphalt is fed ahead of the strike-off edge 176). Then, as the strike-off accessory device 10 is propelled along the path being paved, the asphalt is leveled as the bottom edges 176 of the overlapping rear plates 118 of the strike-off assembly 22 pass thereover. After which, the asphalt is compacted using a steam roller in the same manner as that described above for the conventional paving process.

Figure 12:
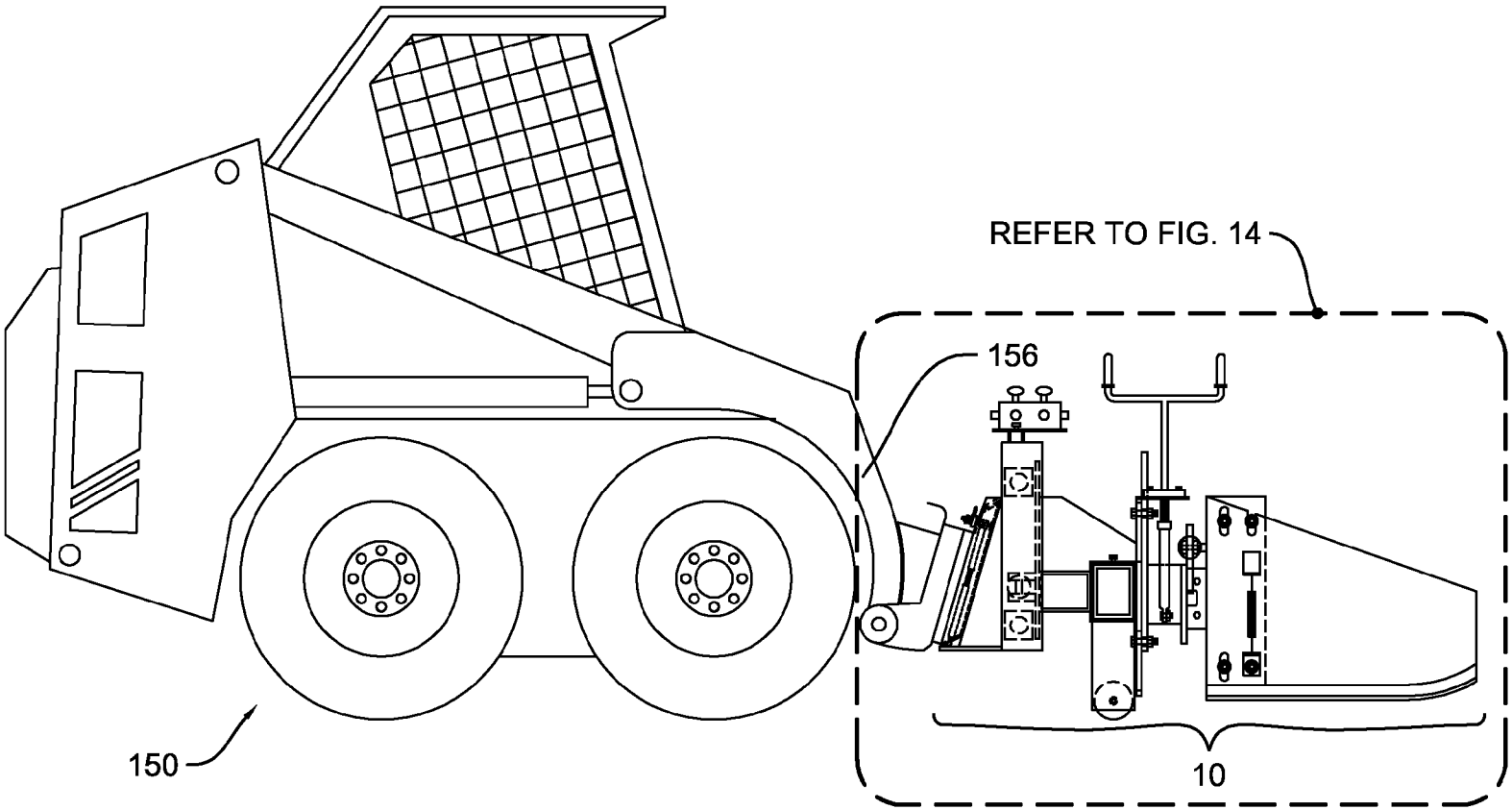
FIG. 12 is a side view of the strike-off accessory device attached to a skid-steer loader according to an embodiment of the invention.
Figure 13:
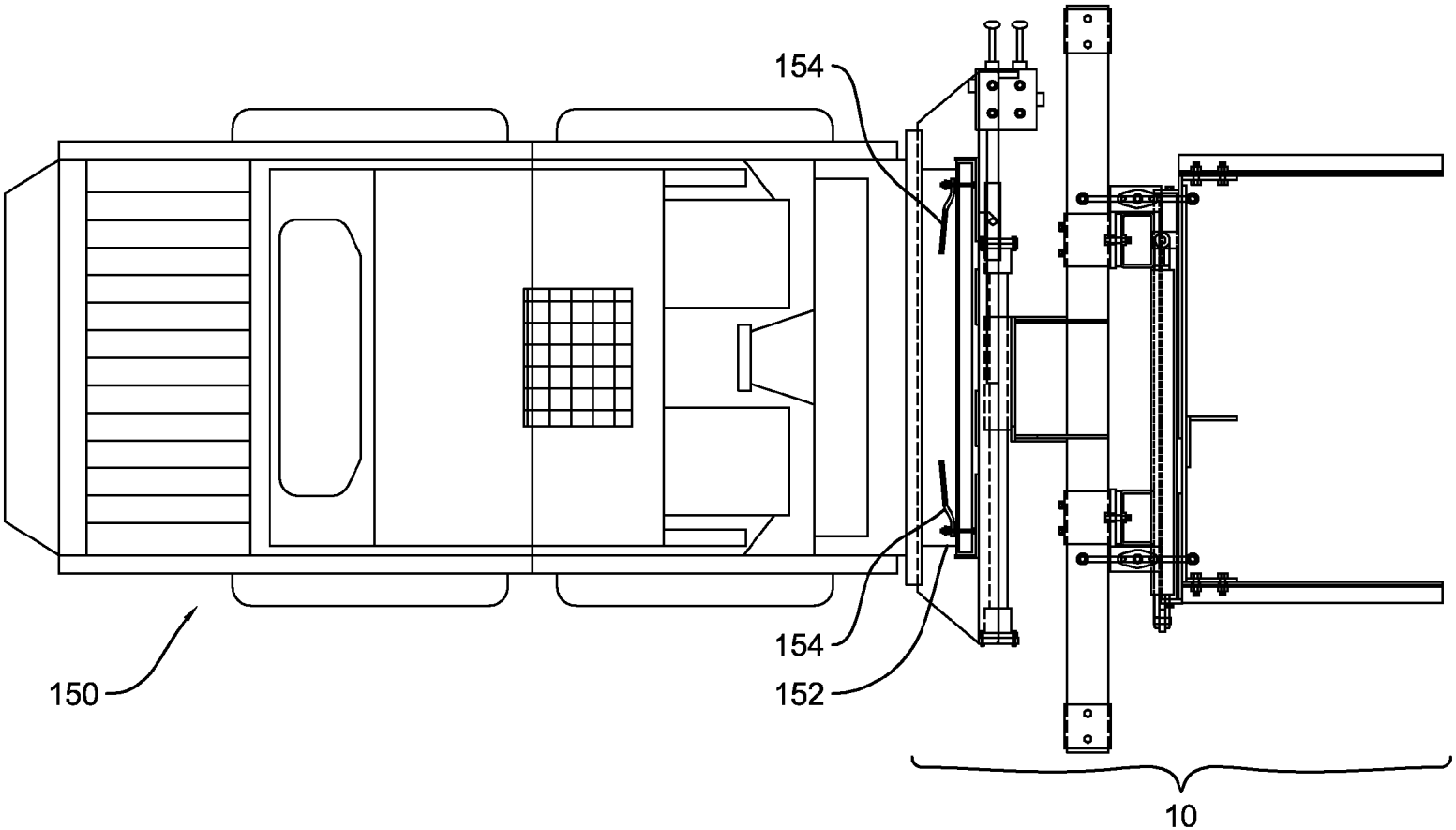
FIG. 13 is a top view of the strike-off accessory device attached to a skid-steer loader according to an embodiment of the invention.

In a preferred embodiment of the invention, the strike-off accessory device 10 is designed to be removably attached to the front of a skid-steer loader 150 (see FIGS. 12 and 13). More particularly, as depicted in FIGS. 12 and 13, the strike-off accessory device 10 is configured to be removably secured to an accessory/attachment mounting assembly 152 provided on the front ends of the skid-steer loader lift arms 156. Preferably, the accessory/attachment mounting assembly 152 is a universal-type mounting device that is configured to fit a plethora of different accessories/attachments by various manufacturers. In one exemplary, non-limiting embodiment of the invention, the accessory/attachment mounting assembly 152 is the Power Bob-Tach® system by the Bobcat® Company. However, one of ordinary skill in the art will readily appreciate that other suitable accessory/attachment mounting assemblies could be used with the present invention as well.

Figure 14:
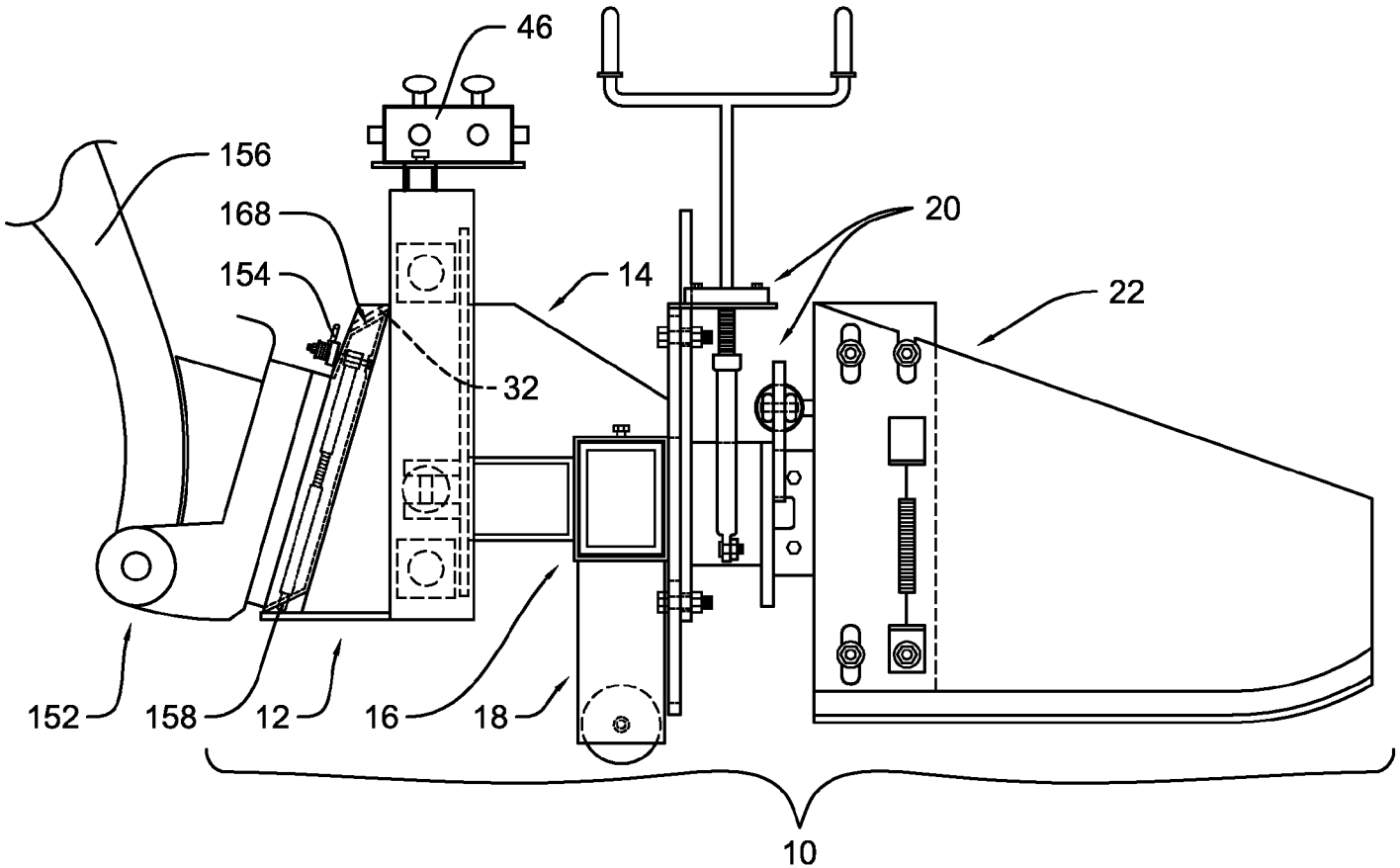
FIG. 14 is an enlarged side view of the strike-off accessory device and accessory attachment means of the skid-steer loader according to an embodiment of the invention.

Now, referring to FIGS. 13 and 14, the manner in which the strike-off accessory device 10 is attached to, and detached from, the accessory/attachment mounting assembly 152 on the skid-steer loader 150 will be explained. First, in order to attach the strike-off accessory device 10 to the accessory/attachment mounting assembly 152 on the skid-steer loader 150, the operator of the skid-steer loader 150 maneuvers the loader lift arms 156 so that the top edge 168 of the mounting assembly 152 is positioned underneath the protruding portion 32 of the latch assembly frame portion 24 on the universal mounting board 12 (see FIGS. 1 and 13). After which, the plate-like front portion of mounting assembly 152 is positioned within a recess 170 defined by the latch assembly frame portion 24 by lowering the bottom edge of the mounting assembly 152 against the lower interior surface 172 of the latch assembly frame portion 24 (see FIGS. 1 and 14). Once the accessory/attachment mounting assembly 152 is properly positioned within the recess 170 of the latch assembly frame portion 24 (see FIG. 1) on the universal mounting board 12, a user rotates each of the two handles 154 located on the top of the mounting assembly 152 (see FIG. 13) inwardly towards the center of the accessory/attachment mounting assembly 152 until each is oriented generally parallel to the top of the mounting assembly 152. As the handles 154 are rotated inwardly towards their generally parallel orientation, a locking pin 158 (see FIG. 14) that is operatively coupled to a respective handle 154 via a locking pin assembly is lowered downwardly until the distal end of the locking pin 158 engages a respective latch pin hole 30 in the latch assembly frame portion 24 (see FIG. 3). Once each locking pin 158 is engaged with its respective latch pin hole 30, the strike-off accessory device 10 is securely attached to the accessory/attachment mounting assembly 152 of the skid-steer loader 150. Finally, before using the strike-off accessory device 10, a user must simply connect the hydraulic supply and return lines 136, 138 to the hydraulic line connectors 148 on the frame of the skid-steer loader 150 (see FIG. 11).

In order to detach the strike-off accessory device 10 from the accessory/attachment mounting assembly 152 of the skid-steer loader 150, a user initially detaches the hydraulic supply and return lines 136, 138 from the hydraulic line connectors 148 on the frame of the skid-steer loader 150 (see FIG. 11). Then, a user rotates each of the two handles 154 located on the top of the mounting assembly 152 (see FIG. 13) outwardly away from the center of the accessory/attachment mounting assembly 152 until each is oriented substantially perpendicular to the top of the mounting assembly 152. Once the handles 154 have been rotated to their substantially perpendicular positions, the respective locking pins 158 (see FIG. 14) operatively coupled thereto are disengaged from their respective latch pin holes 30 in the latch assembly frame portion 24 (see FIG. 3). Then, the operator of the skid-steer loader 150 maneuvers the loader lift arms 156 so that the top edge 168 of the mounting assembly 152 becomes disengaged from the protruding portion 32 of the latch assembly frame portion 24 on the universal mounting board 12 (see FIGS. 1 and 14). After which, the plate-like front portion of mounting assembly 152 is completely removed from the recess 170 of the latch assembly frame portion 24 (see FIGS. 1 and 14) as a result of the maneuvering of the loader lift arms 156 by the operator of the skid-steer loader 150. At this point, the strike-off accessory device 10 is entirely detached from the accessory/attachment mounting assembly 152 of the skid-steer loader 150.

While exemplary embodiments have been described herein, one of ordinary skill in the art will readily appreciate that the exemplary embodiments set forth above are merely illustrative and should not be construed as to limit the claims in any manner. Rather, the scope of the invention is defined only by the appended claims and their equivalents, and not, by the preceding description.

The invention claimed is:

1. A strike-off accessory device configured to be mounted on a vehicle, the strike-off accessory device comprising:

a strike-off assembly for leveling the top surface of a bulk material, said strike-off assembly having a first side member including a bottom edge, a second side member including a bottom edge, said second side member being spaced apart from said first side member by a lateral distance, and at least one rear member disposed between said first side member and said second side member, said at least one rear member including a bottom edge that is configured to contact said bulk material;

a mounting assembly coupled to said strike-off assembly, said mounting assembly being configured to structurally support said strike-off assembly from said vehicle; and a height adjustment assembly disposed between said strike-off assembly and said mounting assembly, said height adjustment assembly including at least one pair of plate members, a first of said plate members being coupled to said at least one rear member of said strike-off assembly, a second of said plate members being coupled to said mounting assembly, said first of said plate members being slidably disposed relative to said second of said plate members in a vertical direction such that an elevation of said bottom edge of said at least one rear member of said strike-off assembly and an elevation of said bottom edge of at least one of said first and second side members of said strike-off assembly are collectively adjustable by a user of said strike-off accessory device so as to accommodate a plurality of desired bulk material depths;

wherein said lateral distance between said first side member and said second side member is selectively adjustable by a user of said strike-off accessory device.

2. The strike-off accessory device according to claim 1, wherein the lateral position of said strike-off assembly is selectively adjustable relative to a portion of said mounting assembly by said user of said strike-off accessory device.

3. The strike-off accessory device according to claim 2 further comprising:

at least one actuator operatively coupled to said strike-off assembly by means of at least one intermediate component; and a control lever operatively coupled to said at least one actuator;

wherein said at least one actuator is configured to adjust said lateral position of said strike-off assembly when said control lever is displaced by said user.

4. The strike-off accessory device according to claim 3, wherein said at least one actuator is a hydraulic actuator and said control lever is pivotably mounted on a hydraulic valve body, wherein said at least one actuator is fluidly coupled to said hydraulic valve body by at least one hydraulic line.

5. The strike-off accessory device according to claim 1, wherein said at least one rear member comprises two overlapping rear plates, one of said two overlapping rear plates being laterally displaceable relative to the other of said two overlapping rear plates.

6. The strike-off accessory device according to claim 5 further comprising:

at least one actuator operatively coupled to said strike-off assembly; and a control lever operatively coupled to said at least one actuator;

wherein said at least one actuator is configured to displace said one of said two overlapping rear plates when said control lever is displaced by said user, thereby adjusting said lateral distance between said first side member and said second side member.

7. The strike-off accessory device according to claim 6, wherein said at least one actuator is a hydraulic actuator and said control lever is pivotably mounted on a hydraulic valve body, wherein said at least one actuator is fluidly coupled to said hydraulic valve body by at least one hydraulic line.

8. The strike-off accessory device according to claim 1, wherein said first of said plate members of said height adjustment assembly is attached to said second of said plate members of said height adjustment assembly by at least one removable fastener such that said strike-off assembly is capable of being detached from said mounting assembly.

9. The strike-off accessory device according to claim 8, wherein said height adjustment assembly further comprises:

at least one height adjustment screw mechanism operatively coupled to said strike-off assembly by means of at least one intermediate component; and at least one height adjustment control handle operatively coupled to said at least one height adjustment screw mechanism;

wherein said at least one height adjustment screw mechanism is configured to collectively adjust said elevation of said bottom edge of said at least one rear member of said strike-off assembly and said elevation of said bottom edge of at least one of said first and second side members of said strike-off assembly when said at least one height adjustment control handle is rotated by said user.

10. The strike-off accessory device according to claim 1 further comprising:

at least one first actuator operatively coupled to said strike-off assembly by means of at least one first intermediate component;

a first control lever operatively coupled to said at least one first actuator;

at least one second actuator operatively coupled to said strike-off assembly;

a second control lever operatively coupled to said at least one second actuator; and wherein said height adjustment assembly further comprises:

at least one height adjustment screw mechanism operatively coupled to said strike-off assembly by means of at least one second intermediate component; and at least one height adjustment control handle operatively coupled to said at least one height adjustment screw mechanism; and wherein said at least one first actuator is configured to adjust the lateral position of said strike-off assembly relative to a portion of said mounting assembly when said first control lever is displaced by said user, said at least one second actuator is configured to adjust said lateral distance between said first side member and said second side member of said strike-off assembly when said second control lever is displaced by said user, and said at least one height adjustment screw mechanism is configured to collectively adjust said elevation of said bottom edge of said at least one rear member of said strike-off assembly and said elevation of said bottom edge of at least one of said first and second side members of said strike-off assembly when said at least one height adjustment control handle is rotated by said user.

11. The strike-off accessory device according to claim 1 further comprising a laterally-extending beam operatively coupled to both said strike-off assembly and said mounting assembly and at least one wheel assembly removably connected to said laterally-extending beam assembly, said at least one wheel assembly including an interchangeable wheel that is configured to rotate along a surface which is located adjacent to said bulk material.

12. The strike-off accessory device according to claim 11, wherein said strike-off assembly is removably coupled to said laterally-extending beam by means of a plurality of collar members and a plurality of vertically-extending plates.

13. The strike-off accessory device according to claim 1, wherein said first side member, said second side member, and said at least one rear member are all in the form of plates.

14. The strike-off accessory device according to claim 1, wherein said bulk material comprises one of the following: (i) asphalt; (ii) concrete; or (iii) gravel.

15. The strike-off accessory device according to claim 1, wherein said lateral distance between said first side member and said second side member is adjustable within a range between approximately thirty-six inches and approximately fifty-seven inches.

16. A strike-off accessory device configured to be mounted on an off-road vehicle, the strike-off accessory device comprising:

a strike-off assembly for leveling the top surface of a bulk material, said strike-off assembly having a first side member including a bottom edge, a second side member including a bottom edge, said second side member being spaced apart from said first side member by a lateral distance, and at least one rear member disposed between said first side member and said second side member, said at least one rear member including a bottom edge that is configured to contact said bulk material;

a mounting assembly operatively coupled to said strike-off assembly, said mounting assembly being configured to structurally support said strike-off assembly from said off-road vehicle, said mounting assembly further being configured to matingly engage with a universal accessory attachment means on said off-road vehicle;

a height adjustment assembly disposed between said strike-off assembly and said mounting assembly, said height adjustment assembly including at least one pair of plate members, a first of said plate members being coupled to said at least one rear member of said strike-off assembly, a second of said plate members being coupled to said mounting assembly, said first of said plate members being slidably disposed relative to said second of said plate members in a vertical direction such that an elevation of said bottom edge of said at least one rear member of said strike-off assembly and an elevation of said bottom edge of at least one of said first and second side members of said strike-off assembly are collectively adjustable by a user of said strike-off accessory device so as to accommodate a plurality of desired bulk material depths; and a transverse position adjustment assembly disposed between said height adjustment assembly and said mounting assembly, said transverse position adjustment assembly including a laterally-extending elongate member coupled to said mounting assembly and at least one attachment member removably coupling said height adjustment assembly and said strike-off assembly to said laterally-extending elongate member, said at least one attachment member being slidably disposed on said laterally-extending elongate member so as to enable the transverse position of said strike-off assembly to be selectively adjusted by a user.

17. The strike-off accessory device according to claim 16, wherein said off-road vehicle is a skid-steer loader and actuation components of said strike-off accessory device are operatively coupled to the hydraulic system of said skid-steer loader.

18. A strike-off accessory device configured to be mounted on a skid-steer loader, the strike-off accessory device comprising:

a strike-off assembly for leveling the top surface of a bulk material, said strike-off assembly having a first side member including a bottom edge, a second side member including a bottom edge, said second side member being spaced apart from said first side member by a lateral distance, and at least one rear member disposed between said first side member and said second side member, said at least one rear member including a bottom edge that is configured to contact said bulk material;

a mounting assembly coupled to said strike-off assembly, said mounting assembly being configured to structurally support said strike-off assembly from said skid-steer loader, said mounting assembly being further configured to matingly engage with a universal accessory attachment means on said skid-steer loader; and a height adjustment assembly disposed between said strike-off assembly and said mounting assembly, said height adjustment assembly including at least one pair of plate members, a first of said plate members being coupled to said at least one rear member of said strike-off assembly, a second of said plate members being coupled to said mounting assembly, said first of said plate members being slidably disposed relative to said second of said plate members in a vertical direction such that an elevation of said bottom edge of said at least one rear member of said strike-off assembly and an elevation of said bottom edge of at least one of said first and second side members of said strike-off assembly are collectively adjustable by a user of said strike-off accessory device so as to accommodate a plurality of desired bulk material depths.

19. The strike-off accessory device according to claim 18, wherein said universal accessory attachment means is mounted to loader lift arms of said skid-steer loader.

20. The strike-off accessory device according to claim 18, wherein said mounting assembly of said strike-off accessory device is capable of being removably connected to said universal accessory attachment means on said skid-steer loader without the use of tools.

* * * * *